US005389429A

United States Patent [19]

Takizawa et al.

[11] Patent Number: 5,389,429

[45] Date of Patent: Feb. 14, 1995

[54] THERMAL TRANSFER MATERIAL AND THERMAL TRANSFER RECORDING METHOD

[75] Inventors: Yoshihisa Takizawa, Kawasaki; Naoki Kushida, Yokohama; Takayuki Suzuki, Saitama; Tetsuo Hasegawa, Tokyo, all of Japan

[73] Assignee: Canon Kabushiki Kaisha, Tokyo, Japan

[21] Appl. No.: 115,105

[22] Filed: Sep. 2, 1993

Related U.S. Application Data

[62] Division of Ser. No. 513,896, Apr. 24, 1990, Pat. No. 5,268,052.

[30] Foreign Application Priority Data

| | | | |
|---|---|---|---|
| Apr. 27, 1989 | [JP] | Japan | 1-111020 |
| Jul. 31, 1989 | [JP] | Japan | 1-198272 |
| Aug. 1, 1989 | [JP] | Japan | 1-201024 |
| Aug. 1, 1989 | [JP] | Japan | 1-201025 |
| Aug. 1, 1989 | [JP] | Japan | 1-201026 |
| Aug. 1, 1989 | [JP] | Japan | 1-201027 |
| Aug. 1, 1989 | [JP] | Japan | 1-201028 |
| Aug. 4, 1989 | [JP] | Japan | 1-203064 |

[51] Int. Cl.[6] ..... B41M 5/00

[52] U.S. Cl. ..... 428/212; 428/195; 428/484; 428/488.1; 428/488.4; 428/522; 428/913; 428/914

[58] Field of Search ..... 428/195, 212, 412, 413, 428/474.4, 480, 484, 488.1, 488.4, 500, 524, 913, 914, 522

[56] References Cited

U.S. PATENT DOCUMENTS

| | | | |
|---|---|---|---|
| 3,368,989 | 2/1966 | Wissinger et al. | 260/23 |
| 3,982,940 | 9/1976 | Kinjo et al. | 96/27 R |
| 4,564,534 | 1/1986 | Kushida et al. | 427/256 |
| 4,624,891 | 11/1986 | Sato et al. | 428/321.3 |
| 4,681,796 | 7/1987 | Maehashi et al. | 428/212 |
| 4,743,920 | 5/1988 | Tohma et al. | 346/71 |
| 4,880,324 | 11/1989 | Sato et al. | 400/241 |
| 4,880,686 | 11/1989 | Yaegashi et al. | 428/212 |
| 4,882,593 | 11/1989 | Touma et al. | 346/111 |
| 4,935,306 | 6/1990 | Ohtsuka et al. | 428/480 |
| 4,948,446 | 8/1990 | Yamahata et al. | 156/234 |
| 4,960,632 | 10/1990 | Tohma et al. | 428/212 |
| 5,008,683 | 4/1991 | Suzuki | 346/1.1 |
| 5,049,903 | 9/1991 | Suzuki | 346/135.1 |
| 5,120,383 | 6/1992 | Takei et al. | 428/913 X |
| 5,147,707 | 9/1992 | Hasegawa et al. | 428/212 |
| 5,268,052 | 12/1993 | Takizawa et al. | 156/234 |
| 5,334,574 | 8/1994 | Matsuda et al. | 428/195 X |

FOREIGN PATENT DOCUMENTS

| | | |
|---|---|---|
| 0126906 | 12/1984 | European Pat. Off. . |
| 0352519 | 1/1990 | European Pat. Off. . |
| 55-105579 | 8/1980 | Japan . |
| 57-83471 | 5/1982 | Japan . |
| 58-7377 | 1/1983 | Japan . |
| 58-201686 | 11/1983 | Japan . |
| 60-120093 | 6/1985 | Japan . |
| 60-178088 | 9/1985 | Japan . |
| 62-027179 | 2/1987 | Japan . |
| 62-027180 | 2/1987 | Japan . |
| 63-089386 | 4/1988 | Japan . |
| 64-25278 | 1/1989 | Japan . |
| 1-099884 | 4/1989 | Japan . |
| 2-128856 | 5/1990 | Japan . |
| 2-204092 | 8/1990 | Japan . |

OTHER PUBLICATIONS

Off. Search Report for Eur. Pat. Appln. No. 90107864.2.

*Primary Examiner*—David A. Simmons
*Assistant Examiner*—J. Sells
*Attorney, Agent, or Firm*—Fitzpatrick, Cella Harper & Scinto

[57] ABSTRACT

A thermal transfer material including a support and a heat-transferable ink layer disposed thereon, wherein the heat-transferable ink layer has a storage elasticity modulus E′ satisfying a relationship of: $1\times10^7 \leqq E' \leqq 1\times10^9$ N/m$^2$ at 30° C.; and the temperature providing a thermal differential value of dynamic energy loss angle (tan δ) satisfying a relationship of $d(\tan\delta)/dT = 1\times10^{-2}$ is in the range of 40° to 60° C.

16 Claims, 12 Drawing Sheets

THERMAL TRANSFER MATERIAL AND THERMAL TRANSFER RECORDING METHOD

This application is a division of application Ser. No. 07/513,896, filed Apr. 24, 1990, U.S. Pat. No. 5,268,052.

FIELD OF THE INVENTION AND RELATED ART

The present invention relates to a thermal transfer material for use in a thermal transfer recording method, particularly to a thermal transfer material capable of providing good recorded images even when used in a smaller amount than that in the conventional thermal transfer recording method.

The thermal or heat-sensitive transfer recording method has recently been widely used because it has general advantages of the thermal recording method such that the apparatus employed is light in weight, compact, free of noise, excellent in operability and adapted to easy maintenance, and also has other advantages such that it does not require a color-formation type converted paper but provides recorded images with excellent durability.

However, in the conventional thermal transfer recording method, since the heat-transferable ink layer of a thermal transfer material is nearly completely transferred to a recording medium (or medium to be recorded) after one heat application, the thermal transfer material is discarded after a single use, whereby the running cost becomes high. Further, the conventional thermal transfer material has a disadvantage such that secrecy can be compromised because a negative version of the printed image is present on the used thermal transfer material.

On the other hand, there have been proposed a large number of methods wherein one thermal transfer material is repeatedly used plural times as disclosed in Japanese Laid-Open Patent Application (JP-A, KOKAI) No. 105579/1980, or a thermal transfer material has a relative velocity with respect to a recording medium so that the amount of the thermal transfer material to be consumed may be reduced, as described in Japanese Laid-Open patent application Nos. 83471/1982 and 7377/1983.

However, these conventional methods have some problems as described below.

One of these problems (first problem) is that ground staining (i.e., unnecessary transfer of an ink) is liable to occur on a recording medium such as paper. This may be attributable to a phenomenon such that a thermal transfer material is rubbed with the recording medium in the above-mentioned recording method, and therefore the ink layer of the thermal transfer material is worn off by the surface of the recording medium, whereby a portion of the ink layer is transferred to the entire surface of the recording medium.

In order to solve the problem of the above-mentioned ground staining, Japanese Laid-Open patent application No. 178088/1985 proposes an overcoating layer containing no colorant which is disposed on an ink layer.

Another problem (second problem) is that unnecessary transfer 20 of an ink in the form of whiskers or bristles occurs in the trailing edge portion of the transferred ink layer with respect to the moving direction of a thermal head, (i.e., the direction of relative velocity of the thermal head with respect to the recording medium, hereinafter, such unnecessary transfer is referred to as "whisker edge portion"), as shown in FIG. 14 described hereinafter. This may be attributable to a phenomenon such that the melt viscosity of the ink layer is considerably decreased due to plural heat applications to the same portion of the ink layer, and the thermal transfer material is rubbed with the recording medium in the above-mentioned conventional recording method.

In order to solve the problem of the whisker edge portion, our research group has proposed a thermal transfer material comprising a support and a heat-transferable ink layer disposed thereon comprising heat-fusible binder and a colorant, wherein the binder comprises an ethylene-vinyl acetate copolymer and a wax, and the ink layer has a breakdown strength of 30–80 kg/cm$^2$ at 25° C. (Japanese Patent Application No. 25278/1989 corr. to U.S. patent application filed on Jan. 31, 1990). By using such a transfer material, not only the whisker edge portion but also the above-mentioned first problem of ground staining has been solved.

The third problem of the above-mentioned recording method is that it is difficult to record one isolated dot which is obtainable by one heat generation of a heat-generating member. This may be attributable to the following reason.

Thus, in the above-mentioned recording method, the heat-transferable ink layer of a thermal transfer material is required to have a thickness larger than that for the conventional thermal transfer recording wherein the thermal transfer material and a recording medium are conveyed so that they have no relative velocity with respect to each other. More specifically, in the above-mentioned recording method, the heat-transferable ink layer is required to have a large thickness in proportion to the number of uses wherein the same portion of the thermal transfer material is repetitively used. As a result, the heat energy emitted from a thermal head is not readily conducted to the surface of the ink layer, whereby the above-mentioned recording of an isolated dot becomes difficult.

In the above-mentioned recording method, as specifically described hereinafter, an unused portion of the heat-transferable ink layer is supplied with heat, when one isolated dot is intended to be recorded. However, when several dots are successively recorded in the printing direction (i.e., a direction reverse to the moving direction of the thermal transfer material), heat is applied to a portion of the heat-transferable ink corresponding to a length of (1/N), wherein 1 denotes the dimension of the heat-generating member of a thermal head and N denotes the number of heat applications to which the same portion of the thermal transfer material 1 can be subjected, but the other portion corresponding to a length of (1–1/N) which has already been subjected to heat application one or more times (maximum, (N-1) times), is again subjected to heat application, whereby the heat-transferable ink layer per se accumulates heat. Accordingly, the printing of the successive several dots may be advantageous, as compared with that of the one isolated dot. Further, due to the above-mentioned heat accumulation, an excessive energy is liable to be imparted to the ink, and therefore it is preferred to rather suppress the energy application, as compared with the conventional thermal transfer recording. Accordingly, in the above-mentioned recording, the recording of one isolated dot further becomes disadvantageous, as compared with that in the conventional thermal transfer recording.

As described above, when an isolated dot is recorded, the ink imparted with heat only reaches a very low temperature, as compared with that in the case of recording of successive several dots. Accordingly, in the above-mentioned recording, the heat-transferable ink layer used therefor is required to have a very high heat sensitivity.

On the other hand, when successively several dots are recorded in the above-mentioned recording method, the same portion of the ink layer is supplied with heat plural times, at most (N-1) times. Since the recording time for each dot is generally several milliseconds, the heat-transferable ink to be supplied with heat plural times is successively subjected to the next heat application, before it is completely cooled to room temperature. Accordingly, the ink reaches a very high temperature (such a phenomenon is referred to as "heat accumulation"). Therefore, even when the heat application is stopped after the recording of successive several dots, it takes a considerable period of time for the ink to be cooled to room temperature, and the heat-transferable ink layer is rubbed with a recording medium also in such a period of time. Accordingly, the above-mentioned unnecessary "whisker edge portion" is liable to occur in the trailing edge portion of the transferred ink layer with respect to the moving direction of a thermal head.

In order to solve the problem of the whisker edge portion, our research group has proposed a thermal transfer material as described in the above-mentioned Japanese Patent Application No. 25278/1989 corr. to U.S. patent application filed on Jan. 31, 1990. However, there is still room for improvement with respect to the recording of one isolated dot.

In addition, our research group has proposed a thermal transfer material to be used for the above-mentioned recording method, wherein the ink layer has a specific melt viscosity (U.S. patent application Ser. No. 367,482).

SUMMARY OF THE INVENTION

A principal object of the present invention is, in view of the above-mentioned problems, to provide a thermal transfer material and a thermal transfer recording method which are not only capable of preventing the ground staining and whisker end portion, but also are capable of recording one isolated dot even when used in a recording method wherein the thermal transfer material has a relative velocity with respect to a recording medium (hereinafter, such a recording method is simply referred to as "double density recording").

According to the present invention, there is provided a thermal transfer material comprising a support and a heat-transferable ink layer disposed thereon, wherein the heat-transferable ink layer has a storage elasticity modulus E' satisfying a relationship of:

$$1\times10^7 \leqq E' \leqq 1\times10^8\ N/m^2$$

at 30° C.; and the temperature providing a thermal differential value of dynamic energy loss angle (tan δ) satisfying a relationship of $d(\tan\delta)/dT=1\times10^{-2}$ is in the range of 40° to 60° C.

The present invention also provides a thermal transfer recording method, comprising:

providing a thermal transfer material as described above;

causing the thermal transfer material to contact a recording medium with its ink layer side;

supplying a pattern of energy from a recording head to the thermal transfer material; and separating the thermal transfer material from the recording medium to leave a transferred image on the recording medium;

wherein the thermal transfer material moves in a unit period of time through a distance relative to the recording head which is smaller than the distance relative to the recording head through which the recording medium moves in the same period of time.

These and other objects, features and advantages of the present invention will become more apparent upon a consideration of the following description of the preferred embodiments of the present invention taken in conjunction with the accompanying drawings, wherein like parts are denoted by like reference numerals. In the description appearing hereinafter, "part(s)" and "%" used for describing quantities are by weight unless otherwise noted specifically.

DETAILED DESCRIPTION OF THE INVENTION

Figure 3:
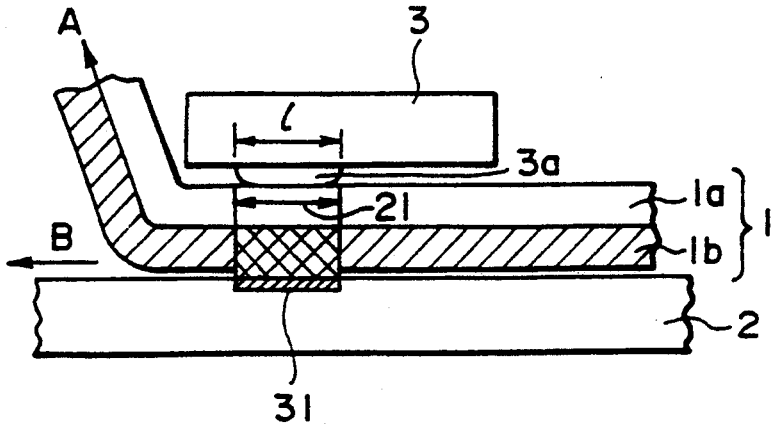
FIGS. 3 to 6 are partial schematic sectional side views for illustrating the recording method according to the present invention each of which shows a relationship among a thermal head, a thermal transfer material and a recording medium.

Referring to FIG. 3, the thermal transfer material 1 according to the present invention comprises a support 1*a* and a heat-fusible (or heat-transferable) ink layer 1*b* disposed thereon.

Figure 1:
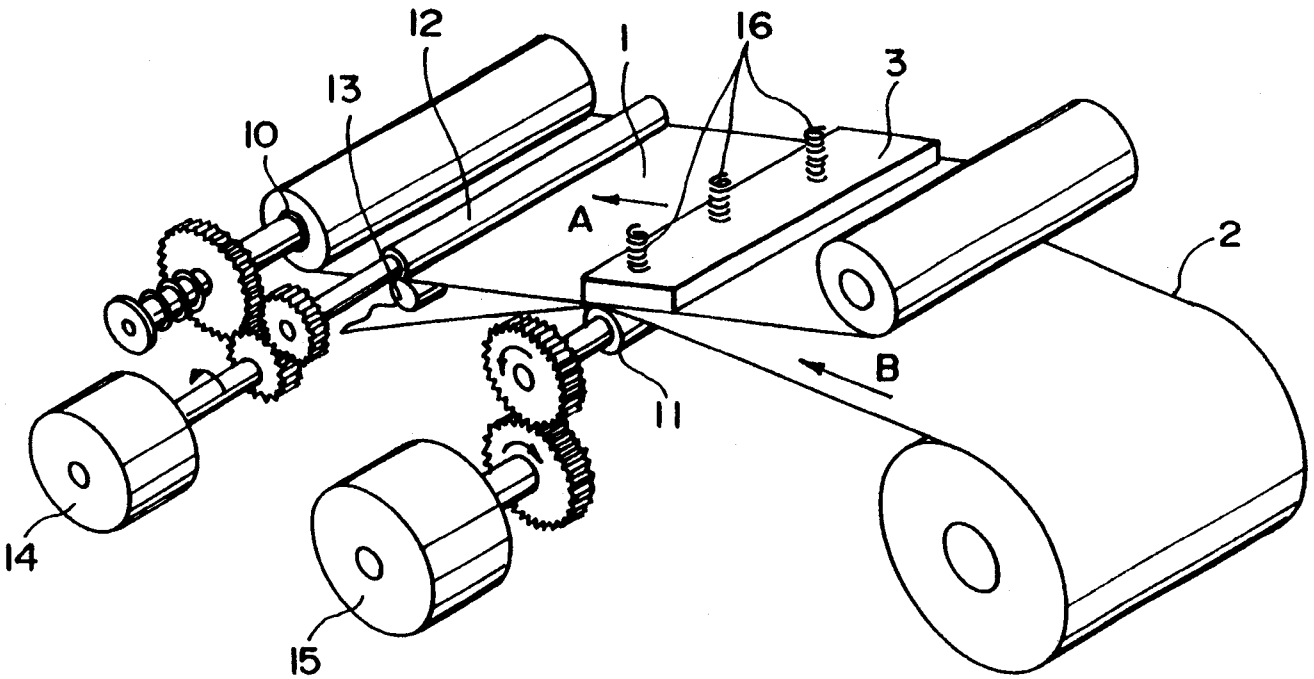
FIGS. 1 and 2 are schematic perspective views each showing an embodiment of the device for practicing the recording method according to the present invention.

FIG. 1 shows an apparatus for practicing an embodiment (i.e., double density recording method) of the thermal transfer recording method using the thermal transfer material according to the present invention.

Referring to FIG. 1, in such a recording method, the thermal transfer material 1 of the present invention is superposed on a recording medium (or medium to be recorded) 2 such as paper so that the heat-fusible ink layer of the thermal transfer material 1 contacts the recording medium 2, and the thermal transfer material 1 is heated by means of a recording head 3 such as thermal head, whereby the heat-fusible ink layer is transferred to the recording medium 2 to provide thereon a recorded image. The thermal transfer material 1 is moved continuously or successively in the directions of an arrow A by the rotation of a capstan roller 12 and a pinch roller 13, while the recording medium 2 is moved continuously or successively in the direction of an arrow B by the rotation of a platen roller 11, whereby recording is successively effected on the recording medium 2. In FIG. 1, the capstan roller 12 and pinch roller 13 are driven by a motor 14, and the platen roller 11 is driven by a motor 15. The thus moved thermal transfer material 1 is wound up about a winding roller 10 driven by the motor 14. A spring 16 presses the recording head 3 on the platen roller 11 by the medium of the thermal transfer material 1 and the recording medium 2.

Figure 2:
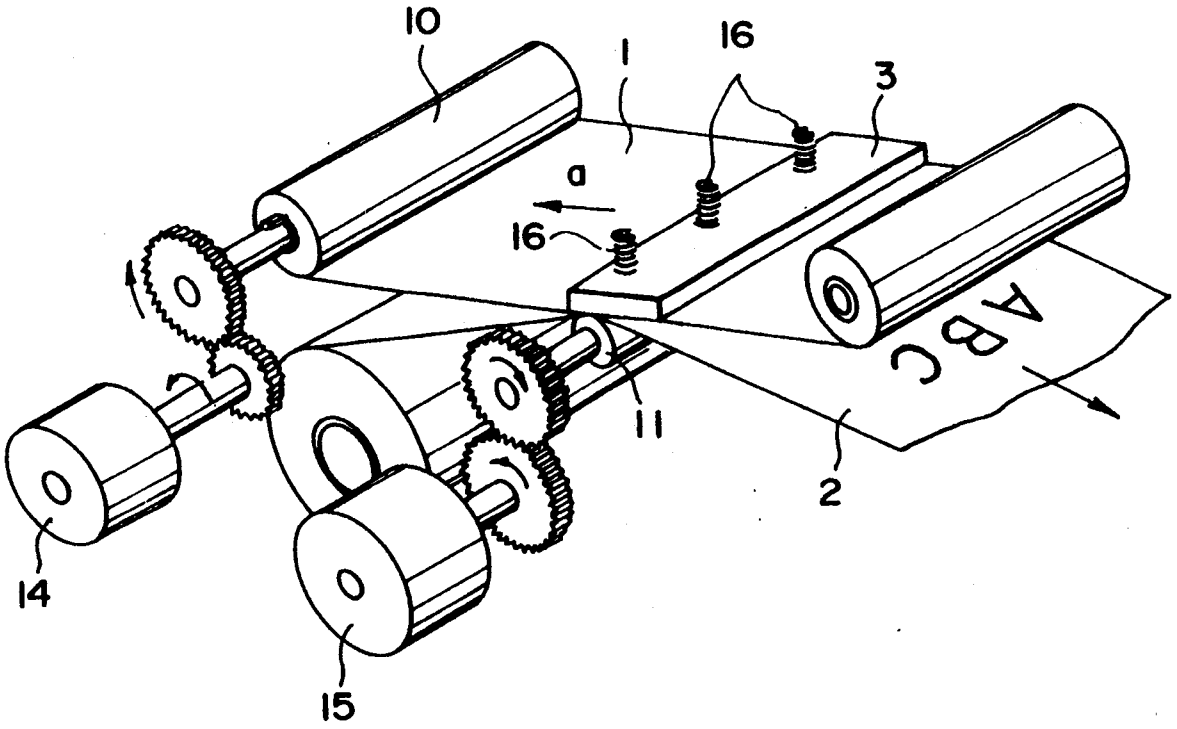

In the embodiment as shown in FIG. 1, the thermal transfer material 1 is moved in the same direction as that of the recording medium 2. In the present invention, however, the thermal transfer material 1 may also be moved in the direction reverse to that of the recording medium 2 as shown in FIG. 2.

In the above-mentioned thermal transfer recording method, the thermal transfer material 1 has a relative velocity with respect to the recording medium 2. In the embodiment shown in FIG. 1, the recording head 3 is not moved while the thermal transfer material 1 is moved at a speed which is lower than that of the recording medium 2. In other words, when a length corresponding to the movement of the thermal transfer material 1 in a certain period of time is compared with that corresponding to the movement of the recording medium 2 in the same period of time, the former is smaller than the latter. As a result, in the above-mentioned recording method, the recording is effected as shown by FIGS. 3 to 6.

Referring to FIG. 3, when the width of the heat-generating member (or element) 3*a* of a recording head 3 in the moving direction of the thermal transfer material 1 (i.e., in the arrow A direction) is represented by l, first heat application is effected on the length l (i.e., a portion 21) of the thermal transfer material 1 which had not been used at all. As a result, a transferred image 31 is formed on the recording medium 2.

Figure 4:
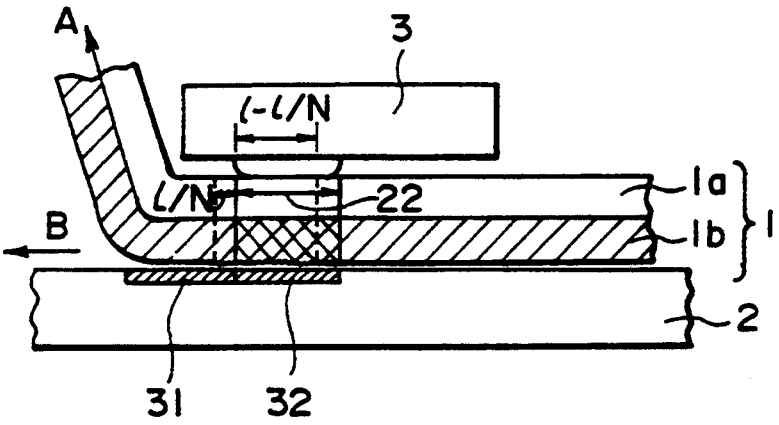

Referring to FIG. 4, at the time of second heat application, the recording medium 2 is moved through a length of l in the arrow B direction, while the thermal transfer material 1 is moved only through a length of l/N. Accordingly, a portion of the thermal transfer material 1 corresponding to the length (l−l/N), which has already been subjected to first heat application, is again used. As a result, in FIG. 4, a portion 22 of the thermal transfer material 1 is subjected to heat application, whereby a transferred image 32 is formed on the recording medium 2.

Herein, the value of "N" is a positive integer ($N \geqq 2$) representing the number of heat applications to which the same portion of the thermal transfer material 1 can be subjected. In the embodiment as shown in FIG. 3, the value of N is 5.

Figure 5:
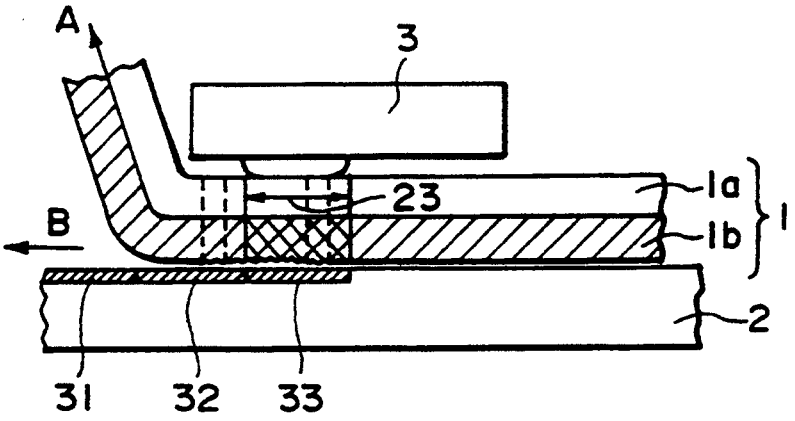
Figure 6:
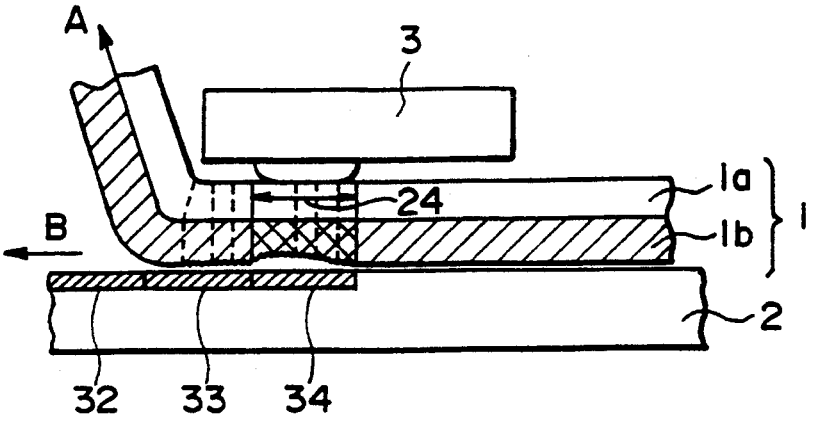

When heat applications are successively effected in such a manner along the longitudinal direction (i.e., the moving direction) of the thermal transfer material 1, at the time of heat application after the second heat application, only a portion of the thermal transfer material 1 corresponding to the length of l/N is unused, and the other portion (at intervals of l/N) which has already been subjected to heat application one or more times, is again subjected to heat application, as shown in FIGS. 4 to 6. More specifically, in FIG. 5, a portion 23 of the thermal transfer material 1 is subjected to heat application, whereby a transferred image 33 is formed on the recording medium 2. Further, in FIG. 6, a portion 24 of the thermal transfer material 1 is subjected to heat application, whereby a transferred image 34 is formed on the recording medium 2. In other words, the same portion of the thermal transfer material 1 is used N times, and the thermal transfer material 1 is moved while rubbing the surface of the recording medium 2.

In the above-mentioned embodiment, the thermal transfer material 1 is moved with respect to the recording head 3 at intervals of l/N, when subjected to second and third heat applications. However, in order to reduce the consumption of the thermal transfer material 1, it is sufficient that the thermal transfer material 1 is moved at intervals each of which is smaller than l and not smaller than l/N. Most effective recording may be effected when the length of travel of the thermal transfer material 1 is l/N counted from the time of a heat application to that of the next heat application. The above-mentioned N may preferably be 2 to 10, more preferably 3 to 8.

While the recording head 3 is not moved in the above-mentioned embodiment, it is also possible to move the recording head 3. Such an embodiment may be considered in the same manner as that explained with reference to FIGS. 3 to 6, when the lengths of travel of the thermal transfer material 1 and recording medium 2 are respectively defined as those counted from the recording head 3 on the basis of the position of the recording head 3. As described above, in the thermal transfer recording method of the present invention, the length through which the thermal transfer material 1 is moved with respect to the recording head 3 in a certain period of time is smaller than the length through which the recording medium 2 is moved with respect to the recording head 3 in the same period of time.

We have earnestly investigated how to obtain a thermal transfer material capable of satisfying the above-mentioned two requirements which are antagonistic to each other such that a high thermal sensitivity of an ink layer is required in order to record one isolated dot, but a low thermal sensitivity is required in order to prevent a whisker edge portion. As a result of such investigations, we have found that the suitability of an ink layer for double density recording may be confirmed by using storage elasticity modulus (E') and thermal differential value of dynamic energy loss angle tan $\delta$ (i.e., d(tan $\delta$)/dT, or derivative of tan $\delta$ with respect to temperature) is viscoelasticity measurement.

Further, we have found that good transferability of one isolated dot is obtained and the whisker edge portion is prevented when a heat-transferable ink layer has specific thermal sensitivity characteristics such that it has a storage elasticity modulus (E') satisfying the following formula at 30° C.:

$$1\times1\times10^7 \leqq E' \leqq 1\times10^9\ N/m^2,$$

and has, in the temperature range of 40° to 60° C. (preferably 45° to 55° C.), a temperature providing a thermal differential coefficient of dynamic energy loss tangent satisfying the following formula:

$$d(\tan\delta)/dT = 1\times10^{-2}$$

The reason for the above-mentioned effect of the thermal transfer material according to the present invention is not precisely understood, but is thought to because in the following manner:

(1) The ink layer causing a whisker edge portion is in a slightly softened state such that softening of the ink layer has been initiated thereof but is not sufficiently softened for transfer.

(2) The ink layer is transferred to a recording medium such as paper under the application of heat. However, during double density recording, since the heat-transferable ink layer is rubbed against the recording medium during heat application, the ink layer initiates its transfer while it is in a special softened state different from a state occurring in the case where it is supplied with heat while it is held stationary relative to the recording medium.

From the above-mentioned two specific viewpoints, we have found that this special softened state is not fully represented by the melting point based on DSC (differential scanning calorimetery), or melt viscosity or flow-initiation temperature based on a flow tester, but is properly represented by $\tan\delta = E''/E'$, which involves the proportion of loss elasticity modulus E'' (corresponding to the viscosity of the ink) to storage elasticity modulus E' (corresponding to the elasticity of the ink). Further, according to our investigation, the special softened state providing $d(\tan\delta)/dT = 1\times10^{-2}$ defines a boundary between the slightly softened state causing the above-mentioned whisker edge portion, and the softened state of the ink allowing sufficient transfer of the ink to provide a recorded image. It is presumably considered that the latter softened state can transfer one isolated dot, and the former and latter softened states are relatively near to each other. Accordingly, both the prevention of whisker-edge portion and the reproduction of an isolated dot may be satisfied in the temperature region providing the above-mentioned value.

When the storage elasticity modulus E' is larger than $1\times10^9$ N/m² at 30° C., the initial elasticity of the heat-transferable ink layer is too large and the desired softened state cannot be obtained even when the relationship $d(\tan\delta)/dT = 1\times10^{-2}$ is satisfied. When E' is smaller than $1\times10^7$ N/m², the initial elasticity of the heat-transferable ink layer is too small and ground staining is liable to occur.

Even when E' at 30° C. satisfies the relationship $1\times10^7 \leqq E' \leqq 1\times10^9$ N/m², the temperature providing $d(\tan\delta)/dT = 1\times10^{-2}$ is lower than 40° C., a whisker edge portion occurs and ground staining can sometimes occur. When the temperature providing $d(\tan\delta)/dT = 1\times10^{-2}$ is higher than 60° C., one isolated dot is insufficiently transferred.

The storage elasticity modulus E', loss elasticity modulus E'' and thermal differential coefficient of dynamic loss tangent ($\tan\delta$) may be measured in the following manner.

Preparation of Sample to be Measured

A sample for dynamic viscoelasticity measurement may be prepared in the following manner:

An ink material which is the same as that constituting the ink layer of a thermal transfer material is applied onto a release paper by means of an applicator or wire bar so as to provide an ink layer having a thickness of 60–200 microns after drying. After the thus applied ink layer is dried, the release paper is removed to prepare an ink film.

The sample may also be prepared in the following manner.

A heat-transferable ink in a melted state is poured into a mold containing a release agent having a predetermined shape (e.g., one having a length of 6 mm, width of 30 mm and a height of 0.2 mm), cooled, and the resultant ink film is released from the mold.

Further, a thermal transfer material comprising a support and a heat-transferable ink layer disposed thereon may be used as the sample as such. In such a case, however, the dynamic viscoelasticity of the resultant two-layer system comprising the support and the heat-transferable ink layer are measured. Therefore, the dynamic viscoelasticity of the heat-transferable ink layer may be determined by subtracting that of the support according to the following theoretical formula:

$$E_1: (Et - E_2t_2)/t_1 \quad (1)$$

E: elasticity modulus of thermal transfer material
t: thickness of thermal transfer material
$E_1$: elasticity modulus of heat-transferable ink layer
$t_1$: thickness of heat-transferable ink layer
$E_2$: elasticity modulus of support
$t_2$: thickness of support.

Measurement Device

A dynamic viscoelasticity measurement device (Reolograph Solid, mfd. by Toyo Seiki Seisakusho K.K.) is used. The storage elasticity modulus E', loss elasticity modulus E'' and dynamic energy loss tangent ($\tan\delta = E''/E'$) may be measured under the following conditions. The thermal differential coefficient of the dynamic energy loss tangent ($\tan\delta$) is calculated on the basis of the thermal change of the $\tan\delta$.

Measurement Condition

Frequency of forced vibration: 9.8 Hz
Static tension: 20 g
Temperature increasing rate: 2° C./min More specifically, a sample having a length of 25 mm, a width of 5 mm and a thickness of 1 mm is used; both ends of the sample are chucked and the above-mentioned static tension is applied the to the sample in the longitudinal direction thereof. In such a state, pressing and pulling of the sample are repeated in the longitudinal direction thereof so as to provide the above-mentioned frequency of forced vibration.

Next, the structure and components to be used for the thermal transfer material according to the present invention are described.

Figure 7:
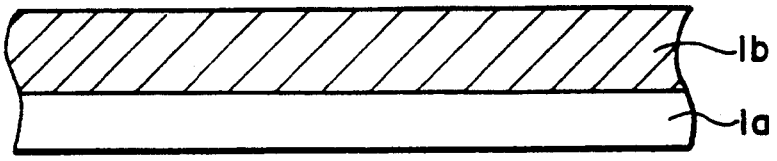
FIG. 7, 8, 12 and 13 are schematic side sectional views each showing an embodiment of the thermal transfer material according to the present invention.

FIG. 7 is a schematic sectional view of an embodiment of the thermal transfer material according to the present invention taken in the thickness direction thereof. Referring to FIG. 7, the thermal transfer material in this embodiment comprises a support 1*a* and a heat-transferable ink layer 1*b* disposed thereon which comprises a heat-fusible binder and a colorant mixed in the binder.

As the support or base material 1*a*, known plastic films or papers may be used. In double density recording, however, since the same portion of the thermal transfer material is supplied with heat plural times as explained hereinabove, a support having high heat resistance such as aromatic polyamide film, polyphenylene sulfide film, polyether ether ketone, and capacitor paper may preferably be used. When there is used a polyester film (particularly, a polyethylene terephthalate film, i.e., PET film) which has suitably been used for thermal transfer materials conventionally, it is preferred to dispose a layer of a heat-resistant and/or lubricating material as a back coating layer, on the surface of the film to be heated (i.e., the surface of the film 1*a* which is reverse to the surface thereof provided with the ink layer 1*b*).

The support 1*a* may preferably have a thickness of 3–20 microns, more preferably 4–12 microns. If sufficient heat resistance and strength are attained, a support can be made thinner than 3 microns. Too thick a support is undesirable because the heat conductivity becomes inferior.

Figure 8:
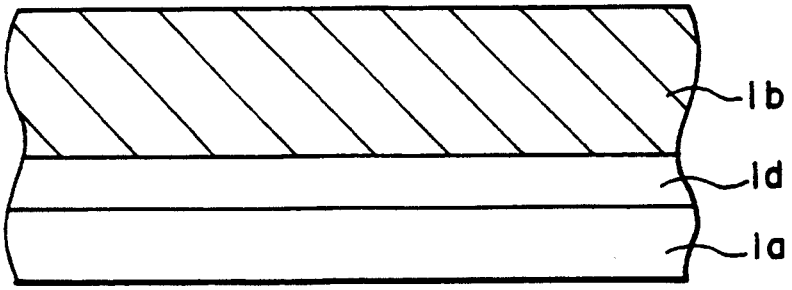

As shown in FIG. 8, an adhesive layer 1*d* may be disposed between the support 1*a* and ink layer 1*b* so as to enhance the adhesion strength therebetween. The adhesive layer 1*d* may preferably comprise 90 to 100% thereof of a resin such as urethane resin and polyester resin. The adhesive layer 1*d* may preferably be one which is not transferable to a recording medium.

The heat-transferable ink layer 1*b* may preferably comprise a heat-fusible binder such as wax and heat-fusible resin.

Example of the above-mentioned wax may include natural waxes including vegetable waxes such as carnauba wax, candelilla wax, rice wax, and haze wax; mineral waxes such as ceresine wax, montan wax and derivatives of these (e.g., derivatives of montan wax including acid wax, ester wax and partially saponified ester wax); and petroleum waxes such as paraffin wax, and microcrystalline wax. Further, there can be used synthetic waxes including polyethylene wax and Fischer-Tropsch wax. These waxes may be used singly or as a combination of two or more species thereof.

Preferred examples of the heat-fusible resin may include: polyolefin resins, polyamide resins, polyester resins, epoxy resins, polyurethane resins, acrylic resins, polyvinyl chloride resins, cellulose resins, polyvinyl alcohol resins, petroleum resins, phenolic resins, styrene resins, and vinyl acetate resins; elastomers such as natural rubber, styrene-butadiene rubber, isoprene rubber, chloroprene rubber and the like; and polyisobutylene, polybutene. Particularly preferred examples may include: ethylene-vinyl acetate copolymer, vinyl acetate-ethylene copolymer, ethylene-acrylic acid copolymer, ethylene-methacrylic acid copolymer, ethylene-acrylic acid ester copolymer, polyamide, polyester, etc. The above-mentioned resins may be used singly or as a combination of two or more species thereof.

The heat-fusible binder to be used in the present invention may preferably comprise a wax and a heat-fusible resin, more preferably 20–75% (particularly 30–65%) of a wax and 80–25% (particularly 35–70%) of a heat-fusible resin, based on the total weight of the binder, so that the heat-transferable ink layer 1*b* provides a storage elasticity modulus E′ satisfying the following formula at 30° C.

$$1\times10^{7}\leqq E'\leqq1\times10^{9}\ N/m^{2}$$

and has a temperature at which the thermal differential coefficient of the dynamic energy loss tangent d(tan δ)/dT$=1\times10^{-2}$, in the temperature range of 40° to 60° C. (particularly 45° to 55° C.).

The wax and heat-fusible resin to be used in the heat-fusible binder may preferably be those which has a good compatibility with each other.

Hereinbelow, the wax and heat-fusible resin to be used in the present invention are more specifically described.

The wax may preferably be one having a melting point measured using DSC (differential scanning calorimetry) of 55°–80° C. and a melt viscosity at 100° C. of 10–500 cps, more preferably 10–200 cps. Further, as described hereinafter, the wax may preferably be one showing a melting behavior ΔT of 20° C. or smaller, more preferably 5°–20° C., particularly preferably 5°–15° C. When ΔT exceeds 20° C., the temperature providing the above-mentioned specific d(tan δ)/dT is difficult to be in the range of 40°–60° C. When ΔT is 20° C. or smaller, the ink layer may sharply be melted and decrease its viscosity more abruptly, whereby "adhesion" as described hereinafter can be reduced and the transferability can be enhanced. Further, the wax may preferably be one having a penetration degree of 5° or below at 25° C.

When the melt viscosity of the wax exceeds 500 cps, the melt viscosity of the entire ink layer is increased and the temperature providing d(tan δ)/dT$=1\times10^{-2}$ is liable to exceeds 60° C.

When the penetration degree of the wax exceeds 5, the hardness of the entire ink layer is reduced and the temperature providing d(tan δ)/dT$=1\times10^{-2}$ is liable to be below 40° C.

In the present invention, the melting point and melting behavior ΔT may be measured by means of the following measurement device.

Measurement Device

A differential scanning calorimeter DSC-7 (mfd. by Perkin Elmer Co.) may be used.

DSC Measurement Condition

Temperature raising rate: 5° C./min

The melting point and ΔT may be measured in the following manner. For example, the results of measurement of Lanox FPS-7 (mfd. by Yoshikawa Seiyu K.K.) are shown in FIGS. 9*a* and 9*b*.

Figures 9A, 9B:
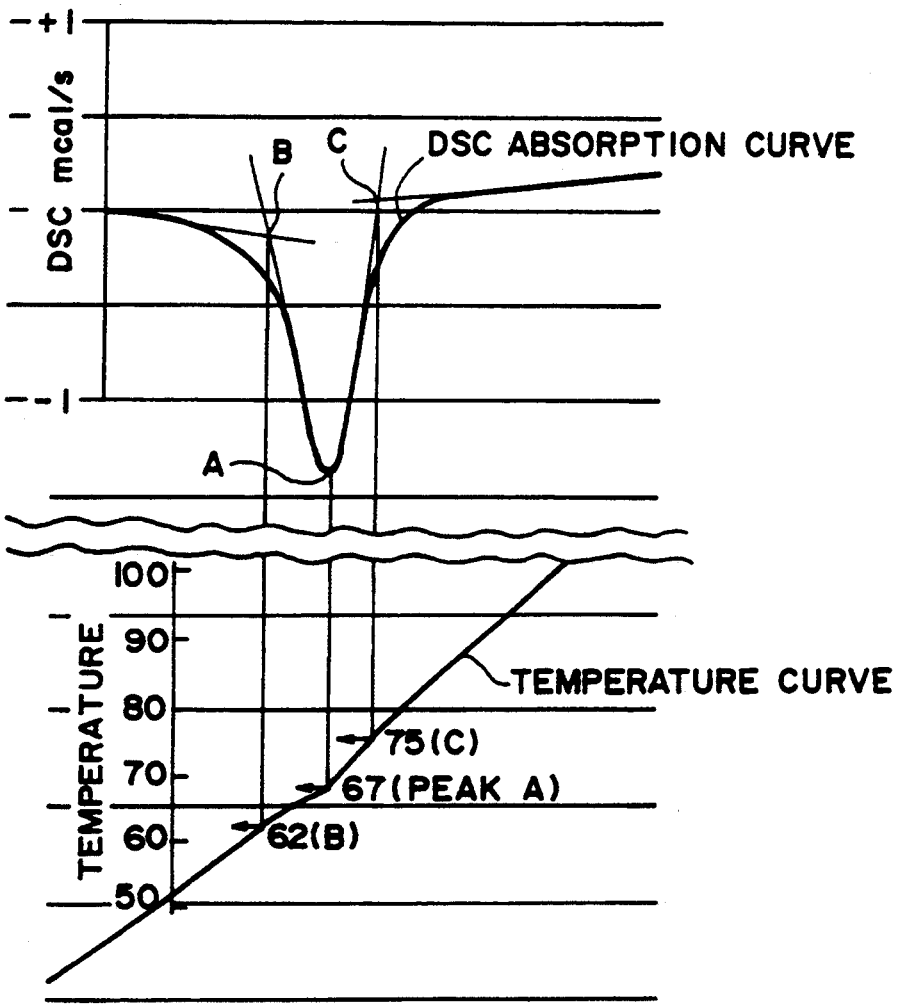
FIGS. 9*a* and 9*b* are graphs for illustrating the respective definitions of the melting point and melting behavior ΔT in the present invention.

In FIG. 9*a*, the point A, i.e., the peak value of the absorption is defined as the melting point. Further, ΔT is defined according to the following formula:

$$\Delta T=Te-Ti,$$

wherein Ti denotes an absorption initiation temperature represented by the point B in FIG. 9*b*, Te denotes an absorption termination temperature represented by the point C in FIG. 9*b*, and the corresponding points B and C in FIG. 9*a* are intersections of the slopes of the peak and base line.

In the present invention, the melt viscosity may be measured by means of the following device.

Device: E-type viscometer (Rotoviseo RV-12, mfd. by Haake Co.)

Cone used: PK-I-0.3.

The heat-fusible resin may preferably be one having a softening point (ring and ball method) of 70°–130° C., more preferably 85°–100° C. Particularly preferred examples thereof may ethylene-vinyl acetate copolymer, ethylene-acrylic acid copolymer and ethylene-ethyl acrylate copolymer. Among these, those having a melt flow rate (MFR) of 150–800, more preferably 150–400 are preferred. Each of the vinyl acetate content (VA content), acrylic acid content (AA content) and ethyl acrylate content (EA content) may preferably be 15–33%, and such a resin having an MFR of 150–400 is particularly preferred.

When the VA content, EA content or AA content is lower than 15%, the temperature providing d(tan $\delta$)/dT$=1\times10^{-2}$ (hereinafter, such a temperature is simply referred to as "coefficient-providing temperature") is liable to be elevated. When the VA content, EA content or AA content is higher than 33%, the coefficient-providing temperature is liable to be below 40° C.

When the MFR is below 150, the coefficient-providing temperature is liable to exceed 60° C. When the MFR exceeds 800, the coefficient-providing temperature is liable to be below 40° C. The MFR may be regulated by using a mixture comprising two or more species of resins.

MFR, VA content, EA content and AA content may be measured in the following manner.

The melt flow rate (MFR) may be measured according to JIS K 6730. The vinyl acetate content (VA content) may be measured according to JIS K 6730. The ethyl acrylate content (EA convent) may be measured in a saponification method which is the same as in the case of the VA content.

Acrylic Acid Content (AA Content)

An ethylene-acrylic acid copolymer is pulverized to obtain fine powder thereof, which is then charged into a mixture of acetone and water (wt. ratio 70:25). Thereafter, phenolphthalein as an indicator is added to the resultant mixture, and the acrylic acid content in the mixture is titrated by using an alcoholic KOH solution while the mixture is stirred. Based on the resultant titration value, the acrylic acid content is calculated.

Among the above-mentioned ethylene-vinyl acetate copolymer, ethylene-acrylic acid copolymer, and ethylene-ethyl acrylate copolymer, the ethylene-vinyl acetate copolymer (EVA) is particularly preferred. When the EVA is used as the heat-fusible resin, the mixing ratio between the EVA and a wax may preferably satisfy the following relationship:

$0.5\leqq EVA/wax\leqq 3.5$.

When the ratio (EVA/wax) is below 0.5, the wax content becomes too large and the elasticity of the entire ink layer is decreased, whereby ground staining is liable to occur. When the ratio (EVA/wax) exceeds 3.5, the film strength of the entire ink layer is enhanced and one isolated dot is difficult to be reproduced.

The wax to be used in the present invention may preferably comprise a compound obtained by subjecting an ester compound containing a residual hydroxyl group and an isocyanate compound to addition polymerization. Such an ester compound may preferably be prepared from a higher fatty acid and a polyhydric alcohol as specifically described hereinafter.

Preferred examples of the higher fatty acid may include: saturated fatty acids such as capric acid, undecylic acid, lauric acid, tridecylic acid, myristic acid, pentadecylic acid, palmitic acid, heptadecylic acid, steraric acid, nonadecanoic acid, arachic acid, biphenic acid, lignoceric acid, cerotic acid, heptacosanoic acid, montanic acid, melissic acid, and lacceric acid; unsaturated fatty acids such as acrylic acid, crotonic acid, isocrotonic acid, 9-decanoic acid, undecylenic acid, oleic acid, elaidic acid, cetoleic acid, erucic acid, brassidic acid, sorbic acid, linoleic acid, linolenic acid, arachidonic acid, clupanodonic acid, 4,8,12,15,28,21-tetra-co-hexaene-acid, propiolic acid, and stearolic acid; branched fatty acids such as isovaleric acid; alicyclic fatty acids such as, sterculic acid, hydrocarpic acid, chaulmoogric acid, and gorlic acid; and oxygen-containing fatty acids such as sabicic acid, ipurolic acid, jalapinolic acid, juniperic acid, ricinoleic acid, and cerebronic acid. Among these, fatty acids having 10–30 carbon atoms and a melting point of 20° C. or higher may more preferably be used. These fatty acids may be used singly or as a combination of two or more species thereof.

Preferred examples of the polyhydric alcohol may include; ethylene glycol, diethylene glycol, triethylene glycol, tetraethylene glycol, polyethylene glycol, propylene glycol, dipropylene glycol, polypropylene glycol, trimethylene glycol, butanediol, pentanediol, hexylenediol, octylene glycol, glycerin, trimethylolpropane, pentaerythritol, dipentaerythritol, 1,3-butylene glycol, glycerin monoallyl, (4-(hydroxyethoxy)phenol)-propane, sorbitol, neopentyl glycol, tris(hydroxyethyl) isocyanuate, bisphenol, hydrogenated bisphenol, bisphenol glycol ether, and epoxides such as triglycidyl isocyanurate.

The ester obtained by the reaction between the above-mentioned higher fatty acid and polyhydric alcohol is required to have a reactivity with an isocyanate compound. The ester may preferably have a carboxyl group based on the fatty acid or a hydroxyl group based on the polyhydric alcohol, as an active hydrogen-containing group. For example, the ester obtained by the reaction of pentaerythritol as a tetrahydric alcohol may be subjected to the reaction with the isocyanate compound as a monoester, diester or triester. These monoester, diester and triester may be used singly or as a mixture of two or three species thereof.

Specific examples of the isocyanate compound may include: mono isocyanates such as methyl isocyanate, ethyl isocyanate, n-propyl isocyanate, n-butyl isocyanate, octadecyl isocyanate and polymethylene polyphenyl isocyanate; diisocyanates such as 2,4-tolylene diisocyanate, 4,4'-diphenylmethane diisocyanate, cyanine diisocyanate, meta-xylylene diisocyanate, 1,5-naphthalene di-isocyanate, transvinylene diisocyanate, N,N'-(4,4'-dimethyl-3,3'-diphenyldiisocyanate), and 2,6-diisocyanate-methyl caproate; triisocyanates such as triphenylmethane triisocyanate, tris(4-phenylisocyanate-thiophosphate), and 4,4',4''-trimethyl-3,3'-3''-triisocyanate-2,4,6-triphenylcyanurate. Among these, diisocyanates and triisocyanate, particularly, aromatic diisocyanates and triisocyanates may preferably be used.

The reaction of the above-mentioned ester and the isocyanate may be conducted under heating and stirring according to an ordinary method. In general, the heating temperature in this reaction may preferably be in the range of about 70°–150° C., since too high a temperature invites considerable coloring of the resultant product, and too low a temperature requires a long reaction time. The above-mentioned reaction may be caused to relatively rapidly progress at a lower temperature by using a metal salt catalyst, such as stannic chloride, ferric chloride, potassium oleate, and dibutyltin laurate. In general, the reaction time may suitably be about 0.5–5 hours.

The amount of the isocyanate used in the above reaction may appropriately be selected depending on the kind of respective material and reaction conditions used. In general, however, the amount of the isocyanate may preferably be about 0.1–40 wt. %, more preferably about 0.1–30 wt. %, based on the weight of the ester, so that a desired polymerization reaction is promoted to provide a wax.

Among the above-mentioned polyhydric alcohols, pentaerythritol is particularly preferred. Accordingly in the present invention, a polymerized product prepared from an isocyanate and a higher fatty acid pentaerythritol ester may preferably used as the wax.

The polymerized product prepared from a fatty acid pentaerythritol ester and an isocyanate (hereinafter referred to as "isocyanate-polymerized product") may show good solubility in an organic solvent, particularly, benzene, toluene, xylene, etc. Accordingly, operating conditions in the production of a thermal transfer material may be improved since the vaporized solvent due to heating of an ink for application may be reduced. Further, since the above polymerized product is less liable to be deposited, a homogeneous heat-transferable ink layer may efficiently be formed.

Further, when the polymerized product prepared from a higher fatty acid pentaerythritol ester and an isocyanate is used, the resultant thermal transfer material is only slightly curled, and is easy to be handled. This may be attributable to a relatively small volume shrinkage factor, when the above isocyanate-polymerized product is converted from a melted state to a solidified state.

In the heat-fusible binder to be used in the present invention, a higher fatty acid polyhydric alcohol ester may more preferably be used, as desired, as the wax component, in combination with the above-mentioned isocyanate-polymerized product prepared from an ester prepared from a higher fatty acid and a polyhydric alcohol. The higher fatty acid polyhydric alcohol ester to be used for such a purpose may be those as described hereinabove. The higher fatty acid polyhydric alcohol ester to be used in combination with the isocyanate-polymerized product is effective in slightly regulating the melting point or melt viscosity of the wax component, whereby the characteristic of the heat-transferable ink can be variously changed.

The mixing amount of the above higher fatty acid polyhydric alcohol ester to be used in combination with the isocyanate-polymerized product may preferably be 50% or below, more preferably 40% or below, particularly preferably 35% or below, based on the total weight of the heat-fusible binder. If the mixing amount exceeds 50%, the wax component is liable to have a poor solubility in a solvent, and deterioration in operating conditions and curl are liable to occur.

The above-mentioned isocyanate-polymerized product, or a mixture of the isocyanate-polymerized product and the higher fatty acid polyhydric alcohol ester (hereinafter, these components are inclusively referred to as "wax main component") may preferably be contained in an amount of 20–75 wt. %, more preferably 30–65 wt. %, based on the total binder weight.

The melting point, melting behavior ΔT and penetration degree of the wax main component may be measured in the same manner as those of the wax as described hereinabove (e.g., melting point by DSC).

As shown in FIGS. 3–6, in the double density recording, a portion of a thermal transfer material is subjected to one heat application, and other portion thereof is subjected to plural heat application, whereby the heated temperatures (i.e., temperatures which the ink layer reaches under heating) of the respective portions of the thermal transfer material may be much different from each other. Accordingly, the thermal transfer material to be used for double density recording may preferably be one comprising a heat-transferable ink layer capable of showing thermal behavior which is not substantially changed depending on the heated temperature thereof.

As a result of various investigations, we have found that a thermal transfer material having a specific melt viscosity characteristic may effectively be used in double density recording with respect to coverage therein. More specifically, such a thermal transfer material may preferably satisfy the following formula:

$$(ln\eta_{100^\circ C.} - ln\eta_{150^\circ C.})/50 \leqq 0.05 \quad (2)$$

wherein $\eta_{100^\circ C.}$ denotes the melt viscosity (cps) of the ink layer at 100° C., an $\eta_{150^\circ C.}$ denotes the melt viscosity thereof at 150° C.

When the above-mentioned $(\ln\eta_{100^\circ C.}\ln\eta_{150^\circ C.})/50$ is larger than 0.05, the thermal behavior may considerably be changed depending on temperature.

In order to obtain a heat-transferable ink layer satisfying the above-mentioned formula, a wax having a melting point of 55°–80° C. (measured by differential scanning calorimetry) may preferably be contained in an amount of 40–75%, more preferably 50–75%, based on the binder.

In double density recording, a thermal transfer material 1 forms a recorded image on a recording medium 2 such as paper while being rubbed with the recording medium. Accordingly, there sometimes occurs a phenomenon such that the thermal transfer material adheres to the recording medium.

We have found that the above-mentioned sticking phenomenon may be suppressed when the following relationship is provided:

$$|mp_2 - mp_1| \leqq 10^\circ C. \quad (3)$$

wherein $mp_1$ denotes the melting point of the wax component of a heat-fusible binder, and $mp_2$ denotes the melting point of the resin component of the heat-fusible binder.

The reason for the above suppression of adhesion may be considered as described hereinbelow.

Figure 10B:
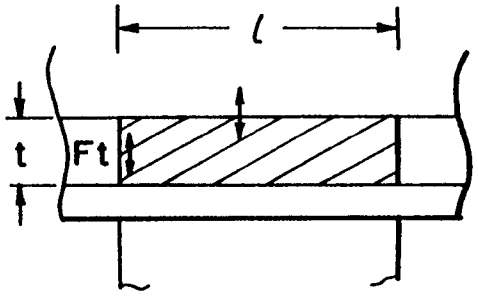
FIGS. 10A and 10B are partial schematic side sectional views for illustrating the forces exerted on the ink layer at the time of peeling in the conventional recording method.
Figure 10A:
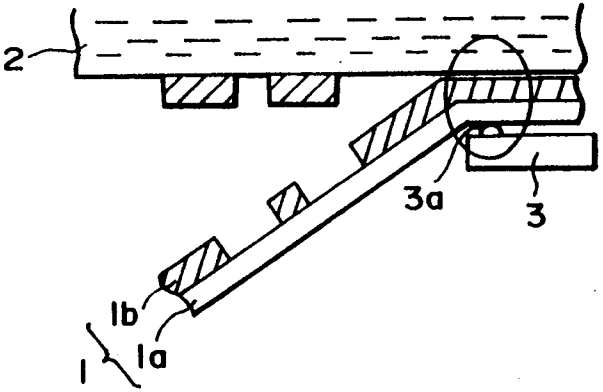

FIGS. 10A and 10B show conventional thermal transfer recording wherein a thermal transfer material 1 has no relative velocity with respect to a recording medium 2. FIG. 10A schematically shows a state at the time of recording and FIG. 10B is an enlarged view for schematically showing some forces exerted on the ink material at the time of heat application.

Referring to FIG. 10B wherein no relative velocity is provided, when the thermal transfer material 1 is supplied with heat by means of a heat-generating member 3*a* of a thermal head 3, at least a surface layer portion or the entire ink layer of a heat-applied portion of the heat-transferable ink layer 1*b* develops a transferability (inclusive of adhesiveness and penetrability) to the recording medium 2. When the thermal transfer material 1 is peeled from the recording medium 2 after the heat application, the force exerted on the heat-transferable ink layer 1*b* is a shear force Ft acting in the thickness direction of the ink layer 1*b*.

Figure 11B:
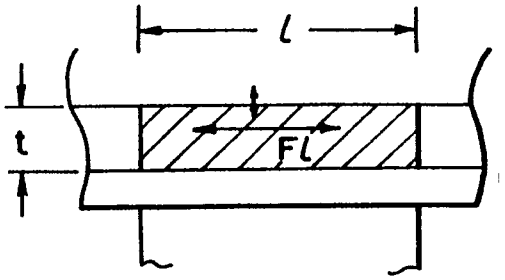
FIGS. 11A and 11B are partial schematic side sectional views for illustrating the forces exerted on the ink layer at the time of peeling in the recording method according to the present invention.
Figure 11A:
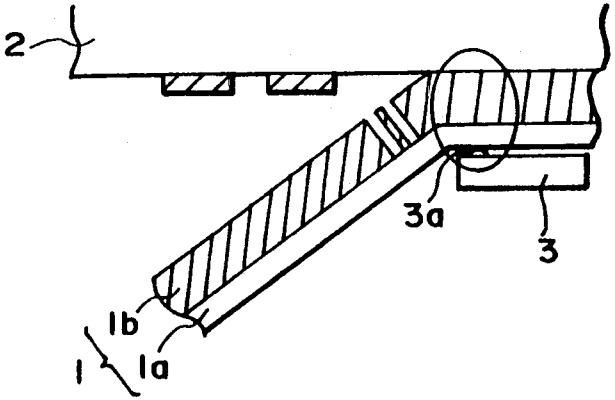

However, in double density recording as shown in FIGS. 11A and 11B, the force exerted on an ink layer 1*b* is a shear force $F_1$ acting in the plane direction of the heat-transferable ink layer 1*b*. In general, the heat-fusible ink layer 1*b* of the thermal transfer material 1 may have a thickness of several microns to some ten (or ten to twenty) microns, and the thermal head 3 may have a heater size of some ten microns to hundred and some ten microns, and $Ft << F_1$ with respect to the shear force exerted on the heat-transferable ink layer 1*b*.

In the conventional recording system providing no relative velocity, even when the peeling of the thermal transfer material 1 from the recording medium 2 is difficult, no serious problem is posed while the so called "delay in peeling" can occur.

However, in the double density recording providing a relative velocity, a transferable image is not provided until a cohesion failure occurs in the heat-transferable ink layer. Accordingly, when the ink layer does not cause the cohesion failure, so-called "adhesion phenomenon" occurs and homogeneity of the resultant transferred image is impaired thereby to provide a portion to which no ink has been transferred.

The wax component as a heat-fusible binder constituting the heat-transferable ink layer is softened or melted at a temperature not lower than the melting point thereof and promotes the softening or melting of a resin component, thereby to develop an adhesion force. Accordingly, the melting point of the wax component may control the transfer initiation of the heat-transferable ink layer to the recording medium 2. However, when the difference between the melting point $mp_1$ of the wax and the melting point $mp_2$ of the resin is considerably large, there is a certain limit to the promotion of the softening or melting of the resin component, even when the wax component is softened or melted. As a result, cohesion failure in the plane direction of the heat-transferable ink layer does not sufficiently occur but the sticking phenomenon is liable to occur.

When the melting point $mp_2$ of the resin is lower than the melting point $mp_1$ of the wax and the difference therebetween is considerably large, the transfer initiation to the recording medium is liable to depend on the melting point of the resin. Accordingly, it is preferred to select a resin having a relatively low molecular weight.

More specifically, in a case where $mp_2 - mp_1 < -10$, the weight-average molecular weight of the resin may preferably be $10 \times 10^4$ or below, more preferably $7 \times 10^4$ or below. However, in the above-mentioned case where $|mp_2 - mp_1| \leqq 10$, the molecular weight of the resin should not be restricted to the above-mentioned molecular weight value.

The colorant may preferably be contained in the ink layer in an amount of 1–50 wt. %, more preferably 5–35%, based on the total weight of the ink layer. If the colorant content is smaller than 1 wt. %, the image density of a recorded image becomes low. On the other hand, the colorant content exceeds 50 wt. %, there can occur undesirable problems such as decrease in the elasticity of the ink layer.

The thickness of the ink layer may preferably be 6–30 g/m$^2$, more preferably 6–20 g/m$^2$, in terms of coating weight after drying, while it depends on the number (N) of heat applications as described hereinabove. When the thickness of the ink layer is below 6 g/m$^2$, a sufficient recording density cannot be obtained in double density recording. When the thickness exceeds 30 g/m$^2$, there undesirably occur problems such as increase in recording energy.

In the present invention, various dyes or pigments may be used as the colorant. Specific examples of such colorant may include one or more of known dyes or pigments such as carbon black, Nigrosine dyes, lamp black, Sudan Black SM, Fast Yellow G, Benzidine Yellow, Pigment Yellow, Indo Fast Orange, Irgadine Red, Paranitroaniline Red, Toluidine Red, Carmine FB, Permanent Bordeaux FRR, Pigment Orange R, Lithol Red 2G, Lake Red C, Rhodamine FB, Rhodamine B Lake, Methyl Violet B Lake, Phthalocyanine Blue, Pigment Blue, Brilliant Green B, Phthalocyanine Green, Oil Yellow GG, Zapon Fast Yellow CGG, Kayaset Y963, Smiplast Yellow GG, Zapon Fast Orange RR, Oil Scarlet, Smiplast Orange G, Orazole Brown G, Zapon Fast Scarlet. CG, Aizen Spiron Red F4R, Fastgert Blue 5007, Sudan Blue, and Oil Peacock Blue.

The heat-fusible binder can further contain another material including: higher fatty acids such as lauric acid, myristic acid, palmitic acid, stearic acid, behenic acid and the like; higher alcohols such as stearyl alcohol, behenyl alcohol and the like; esters such as fatty acid esters of sucrose, fatty acid esters of sorbitan and the like; and amides such as oleic amide and the like.

In order to strongly bond a recorded image to a recording medium, a resin so-called "tackifier" may preferably be added to the heat-fusible binder, as desired.

The tackifier may preferably be one or more species selected from: coumarone-indene resins, phenolformaldehyde resins, polyterpene resins, xylene-formaldehyde resins, polybutene, rosin pentaerythritol ester, rosin glycerin ester, hydrogenated rosin, hydrogenated rosin methyl ester, hydrogenated rosin ethylene glycol ester, hydrogenated rosin pentaerythritol ester, polymerized rosin ester aliphatic petroleum resin, alicyclic petroleum resin, synthetic polyterpene, pentadiene resin, etc. These materials may be used singly or as a mixture of two or more species thereof.

In the description appearing hereinabove, the heat-transferable ink layer to be disposed on a support has a one-layer structure, but the heat-transferable ink layer may have a multi-layer structure comprising two or more layers. In the case of the multi-layer structure, the entirety of the ink layer is required to have a temperature providing $d(\tan \delta)/dT = 1 \times 10^{-2}$ in the range of 40°–60° C.

In the case of the multi-layer structure of the ink layer, the respective ink layer constituting it may be considered in the same manner as in the above-mentioned one-layer structure, but the entire ink layer may preferably provide a mixing proportion satisfying the following formula:

$0.6 \leqq (\text{resin})/(\text{wax}) \leqq 3.0$.

Figure 12:
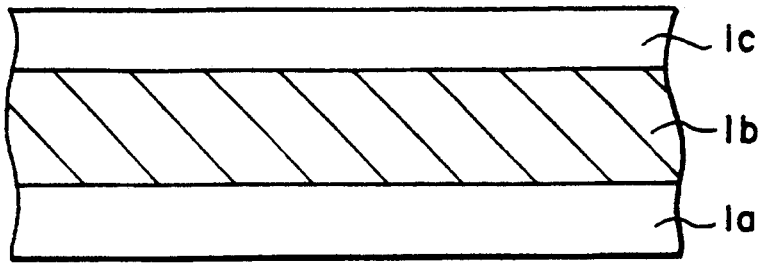

Further, an ink layer 1*c* (i.e., top layer or topcoat layer) as shown in FIG. 12 may be disposed as desired so that the top layer is most distant from a support 1*a* among the ink layers constituting a multi-layer structure. It is preferred to make the top layer transparent, since unnecessary ink is prevented from transferring to a recording medium. Such a transparent top layer 1*c* can also enhance the transferability of the ink layer.

The top layer can contain a colorant while it may preferably contain no colorant. When a colorant is contained in the top layer 1c, the colorant content may preferably be 4.0% or below based on the weight of the top layer 1c.

When the melting point of the top layer 1c is denoted by mp (top), and the melting point of the ink layer is denoted by mp (ink), they may preferably satisfy a relationship of mp(ink)≧mp(top). In such a case, even when a fine recorded image such as a Chinese character is intended to be printed, there does not occur a decrease in resolution such that unnecessary ink is transferred to a recording medium and the details of the resultant recorded image becomes unclear.

In a case where the relationship mp(ink)≧mp(top) is satisfied, the melting point mp(ink) of the ink layer 1b may preferably be 50°-150° C., more preferably 60°-130° C., and the melting point mp(top) of the top layer 1c may preferably be 40°-130° C., more preferably 50°-110° C.

When the melting point of the top layer 1c is lower than 40° C., the heat energy to be applied which is required for ink transfer can be reduced, but a decrease in storability (e.g., offset of an ink material due to blocking) is liable to occur. When the above melting point exceeds 130° C. the heat energy to be applied is increased and the durability of a thermal head is deteriorated.

The difference i.e., (mp(ink)−mp(top)) between the above-mentioned melting point of the ink layer and that of the top layer may more preferably 0°-40° C., particularly 0°-20° C.

Figure 13:
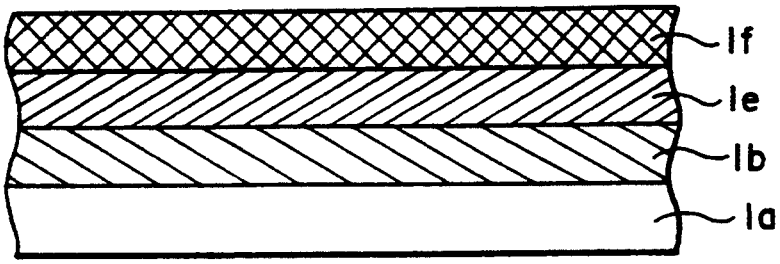
Figure 14:
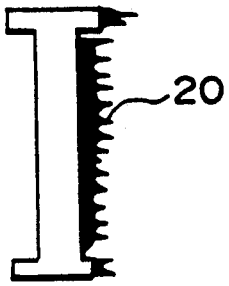
FIG. 14 is a schematic plan view of a recorded image with whisker edge portion provided by a conventional thermal transfer method.

In an embodiment wherein the ink layer is caused to have a multi-layer structure (e.g., one as shown in FIG. 13), the wax contained in each ink layer may preferably be caused to have a higher melting point, as the ink layer becomes closer to a support 1a, since the resolution decrease of a recorded image is more effectively be prevented. The ink layers disposed on a support 1a are named a first ink layer 1b, a second ink layer 1e, a third ink layer 1f, a fourth ink layer, et. seq., in this order from the support.

The difference between melting points of adjacent ink layers may preferably be 2° C. or larger, more preferably 5° C. or larger. When the difference is smaller than 2° C. it is difficult to obtain an intended effect.

The melting point of the wax contained in the ink layer disposed closest to the recording medium may preferably be 50°-80° C., more preferably 55°-75° C., and the melting point of the wax contained in the ink layer disposed closest to the support may preferably be 60°-120° C., more preferably 65°-110° C.

The thermal transfer material of the present invention may preferably be obtained in the following manner (i.e., solvent coating method).

For example, the binder which has been selected in consideration of the above-mentioned viewpoint is dissolved in an organic solvent such as toluene, methyl ethyl ketone, isopropyl alcohol, methanol or xylene, a colorant is then mixed in the resultant solution and sufficiently dispersed by means of a dispersing machine such as sand mill, and the thus obtained coating liquid is applied onto a support by a coating method such as bar coating or gravure coating.

Alternatively, the binder is heated up to a temperature above the softening point thereof, a colorant is dispersed or dissolved therein and the resultant mixture is applied onto a support by a so-called hot-melt coating. Further, the binder and colorant may be formed into an aqueous emulsion by the addition of a dispersant such as surfactant, and the aqueous emulsion may be applied onto a support (or another ink layer) to form an ink layer. When the ink layer has a multi-layer structure, each ink layer may successively be formed by coating methods as described above.

At the time of the application of an ink to a support, when a colored ink having a mono-color (e.g., black color) is applied onto the entire surface of the support, a mono-color thermal transfer material may be obtained. Alternatively, inks having plural colors (e.g., two or more species selected from cyan ink, magenta ink, yellow ink, blue ink, green ink, red ink, etc.) may be applied onto a support repetitively so that ink layers of plural colors may be formed on the support at prescribed intervals with respect to the longitudinal direction or width direction of the support, whereby a thermal transfer material for multi-color recording may be obtained. Multi-color recording may be effected by using such a thermal transfer material so that prescribed colors are superposed on a recording medium.

Hereinbelow, the present invention will be explained more specifically while referring to specific examples of practice.

In the description appearing hereinafter, Lanox (a wax mfd. by Yoshikawa Seiyu K.K.) comprises a mixture of an addition-polymerized product and an esterified product. The addition-polymerized product is obtained by forming an ester from pentaerythritol and a higher fatty acid mixture comprising behenic acid and stearic acid, and subjecting the resultant ester to addition polymerization together with tolylene diisocyanate. The esterified product is obtained by forming an ester from pentaerythritol and a higher fatty acid mixture comprising behenic acid and stearic acid.

EXAMPLE 1

| | |
|---|---|
| Ethylene-vinyl acetate copolymer (Evaflex 210, mfd. by Mitsui-Du Pont Polychemical Co., melt flow rate (MFR) = 400, vinyl acetate content (VA content) = 28%) | 45 parts |
| Wax (FPS-7, mfd. by Yoshikawa Seiyu K.K., melting point measured by DSC (mp) = 68° C., ΔT measured by DSC = 13° C.) | 40 parts |
| Carbon black (MA-11, mfd. by Mitsubishi Kasei K.K.) | 15 parts |
| Toluene | 300 parts |

The above materials were dissolved or dispersed by means of a sand mill, thereby to prepare a coating liquid for heat-transferable ink. The coating liquid was applied onto a 6 micron-thick polyester film having a treated back surface, by means of a wire bar and then dried to form thereon a heat-transferable ink layer having a coating amount of 16 g/m$^2$ (after drying), whereby a thermal transfer material was obtained.

Separately, the above-mentioned coating liquid was applied onto a release paper by means of a wire bar and then dried to form thereon a heat-transferable ink layer. Thereafter, the resultant heat-transferable ink layer was peeled from the release paper, thereby to prepare a sample for dynamic viscoelasticity measurement.

EXAMPLE 2

| | |
|---|---|
| Ethylene-vinyl acetate copolymer (Evaflex 210, mfd. by Mitsui-Du Pont Polychemical Co., MFR = 400, | 45 parts |

-continued

| | |
|---|---|
| VA content = 28%) | |
| Wax | 40 parts |
| (FPS-24, mfd. by Yoshikawa Seiyu K.K., melting point measured by DSC = 63° C., ΔT = 13° C.) | |
| Carbon black | 15 parts |
| (MA-11, mfd. by Mitsubishi Kasei K.K.) | |
| Toluene | 300 parts |

EXAMPLE 3

| | |
|---|---|
| Ethylene-vinyl acetate copolymer | 45 parts |
| (Evaflex 210, mfd. by Mitsui-Du Pont Polychemical Co., MFR = 400, VA content = 28%) | |
| Wax | 40 parts |
| (FRL-1, mfd. by Yoshikawa Seiyu K.K., melting point measured by DSC = 74° C., ΔT = 14° C.) | |
| Carbon black | 15 parts |
| (MA-11, mfd. by Mitsubishi Kasei K.K.) | |
| Toluene | 300 parts |

EXAMPLE 4

| | |
|---|---|
| Ethylene-vinyl acetate copolymer | 45 parts |
| (Evaflex 210, mfd. by Mitsui-Du Pont Polychemical Co., MFR = 400, VA content = 28%) | |
| Wax | 40 parts |
| (FRL-14, mfd. by Yoshikawa Seiyu K.K., melting point measured by DSC = 58° C., ΔT = 15° C.) | |
| Carbon black | 15 parts |
| (MA-11, mfd. by Mitsubishi Kasei K.K.) | |
| Toluene | 300 parts |

EXAMPLE 5

| | |
|---|---|
| Ethylene-vinyl acetate copolymer | 45 parts |
| (Evaflex 420, mfd. by Mitsui-Du Pont Polychemical Co., MFR = 150, VA content = 19%) | |
| Wax | 40 parts |
| (FPS-7, mfd. by Yoshikawa Seiyu K.K., melting point measured by DSC = 68° C., ΔT = 13° C.) | |
| Carbon black | 15 parts |
| (MA-11, mfd. by Mitsubishi Kasei K.K.) | |
| Toluene | 300 parts |

EXAMPLE 6

| | |
|---|---|
| Ethylene-vinyl acetate copolymer | 45 parts |
| (Evaflex V577, mfd. by Mitsui-Du Pont Polychemical Co., HMR = 800, VA content = 19%) | |
| Wax | 40 parts |
| (FPS-7, mfd. by Yoshikawa Seiyu K.K., melting point measured by DSC = 68° C., ΔT = 13° C.) | |
| Carbon black | 15 parts |
| (MA-11, mfd. by Mitsubishi Kasei K.K.) | |
| Toluene | 300 parts |

EXAMPLE 7

| | |
|---|---|
| Ethylene-vinyl acetate copolymer | 45 parts |
| (Evaflex 210, mfd. by Mitsui-Du Pont Polychemical Co., HMR = 400, VA content = 28%) | |
| Ester wax | 40 parts |
| (Hoechst Wax E, mfd. by Hoechst, melting point measured by DSC = 80° C., ΔT = 20° C.) | |
| Carbon black | 15 parts |
| (MA-11, mfd. by Mitsubishi Kasei K.K.) | |
| Toluene | 300 parts |

EXAMPLE 8

| | |
|---|---|
| Ethylene-vinyl acetate copolymer | 45 parts |
| (Evaflex 210, mfd. by Mitsui-Du Pont Polychemical Co., MFR = 400, VA content = 28%) | |
| Wax | 40 parts |
| (FPS-7, mfd. by Yoshikawa Seiyu K.K., melting point measured by DSC = 68° C., ΔT = 13° C.) | |
| Carbon black | 15 parts |
| (MA-11, mfd. by Mitsubishi Kasei K.K.) | |
| Toluene | 300 parts |

EXAMPLE 9

| | |
|---|---|
| Ethylene-vinyl acetate copolymer | 65 parts |
| (Evaflex 210, mfd. by Mitsui-Du Pont Polychemical Co., MFR = 400, VA content = 28%) | |
| Wax | 20 parts |
| (FPS-7, mfd. by Yoshikawa Seiyu K.K., melting point measured by DSC = 68° C., ΔT = 13° C.) | |
| Carbon black | 15 parts |
| (MA-11, mfd. by Mitsubishi Kasei K.K.) | |
| Toluene | 300 parts |

COMPARATIVE EXAMPLE 1

| | |
|---|---|
| Carnauba wax | 40 parts |
| (Carnauba No. 1, mfd. by Kato Yoko K.K., melting point of DSC = 83° C., ΔT = 18° C.) | |
| Ethylene-vinyl acetate copolymer | 12 parts |
| (Evaflex 220, mfd. by Mitsui-Du Pont Polychemical Co., MFR = 150, VA content = 28%) | |
| Paraffin wax | 33 parts |
| (HNP-11, mfd. by Nihon Seiro K.K., melting point measured by DSC = 69° C., ΔT = 15° C.) | |
| Carbon black | 15 parts |
| (MA-11, mfd. by Mitsubishi Kasei K.K.) | |

COMPARATIVE EXAMPLE 2

| | |
|---|---|
| Ethylene-vinyl acetate copolymer | 72 parts |
| (MB080, mfd. by Nippon Unicar K.K., MFR = 2500, VA content = 19%) | |
| Wax | 13 parts |
| (FP7136, mfd. by Yoshikawa Seiyu K.K., melting point measured by DSC = 60° C., ΔT = 27° C.) | |
| Carbon black | 15 parts |
| (MA-11, mfd. by Mitsubishi Kasei K.K.) | |

-continued

| | |
|---|---|
| Toluene | 300 parts |

COMPARATIVE EXAMPLE 3

| | |
|---|---|
| Ethylene-vinyl acetate copolymer (Evaflex 550, mfd. by Mitsui-Du Pont Polychemical Co., MFR = 15, VA content = 14%) | 45 parts |
| Microcrystalline wax (Hi-Mic 1080, mfd. by Nihon Seiro K.K., melting point measured by DSC = 84° C., ΔT = 35° C.) | 40 parts |
| Carbon black (MA-11, mfd. by Mitsubishi Kasei K.K.) | 15 parts |
| Toluene | 300 parts |

COMPARATIVE EXAMPLE 4

| | |
|---|---|
| Ethylene-vinyl acetate copolymer (MB010, mfd. by Nippon Unicar K.K, MFR = 1200, VA content = 25%) | 45 parts |
| Paraffin wax (Paraffin Wax 120F, mfd. by Nihon Seiro K.K., melting point measured by DSC = 50° C., ΔT = 20° C.) | 40 parts |
| Carbon black (MA-11, mfd. by Mitsubishi Kasei K.K.) | 15 parts |
| Toluene | 300 parts |

12 species of thermal transfer materials were prepared in the same manner as in Example 1 except for using each of formulations of Examples 2 to 9 and Comparative Examples 1, 3 and 4. The thermal transfer material of Comparative Example 2 was prepared by hot-melt coating method.

Separately, 12 species of samples for dynamic viscoelasticity measurement were prepared in the same manner as in Example 1 except for using each of the above-mentioned formulations.

EXAMPLES 10–19 AND COMPARATIVE EXAMPLES 5–6

The materials as described hereinafter were respectively dissolved or dispersed by means of a sand mill, thereby to prepare 12 species of coating liquids for heat-transferable ink. Each coating liquid was applied onto a 6 micron-thick polyester film having a treated back surface, by means of a wire bar and then dried by using hot air to form thereon a heat-transferable ink layer having a coating amount of 16 g/m$^2$ (after drying), whereby 12 species of thermal transfer materials were obtained.

EXAMPLE 10

| | |
|---|---|
| Lanox FP8208 (melting point = 68° C., melt viscosity = 83 cps at 100° C., ΔT = 16° C.) | 46 parts |
| Ethylene-vinyl acetate copolymer (Evaflex EV210, mfd. by Mitsui-Du Pont Polychemical Co., MFR = 400, VA content = 28%) | 39 parts |
| Carbon black (MA-11, mfd. by Mitsubishi Kasei K.K.) | 15 parts |
| Toluene | 300 parts |

EXAMPLE 11

| | |
|---|---|
| Lanox FPS-2 (melting point = 67° C., melt viscosity = 35 cps at 100° C., ΔT = 11° C.) | 45 parts |
| Ethylene-vinyl acetate copolymer (Evaflex EV210, mfd. by Mitsui-Du Pont Polychemical Co., MFR = 400, VA content = 28%) | 40 parts |
| Carbon black (MA-11, mfd. by Mitsubishi Kasei K.K.) | 15 parts |
| Toluene | 300 parts |

EXAMPLE 12

| | |
|---|---|
| Lanox FPL-237 (melting point = 70° C., melt viscosity = 31 cps at 100° C., ΔT = 16° C.) | 43 parts |
| Ethylene-vinyl acetate copolymer (Evaflex EV210, mfd. by Mitsui-Du Pont Polychemical Co., MFR = 400, VA content = 28%) | 42 parts |
| Carbon black (MA-11, mfd. by Mitsubishi Kasei K.K.) | 15 parts |
| Toluene | 300 parts |

EXAMPLE 13

| | |
|---|---|
| Lanox FPS-22 (melting point = 66° C., melt viscosity = 35 cps at 100° C., ΔT = 10° C.) | 45 parts |
| Ethylene-vinyl acetate copolymer (Evaflex EV210, mfd. by Mitsui-Du Pont Polychemical Co., MFR = 400, VA content = 28%) | 40 parts |
| Carbon black (MA-11, mfd. by Mitsubishi Kasei K.K.) | 15 parts |
| Toluene | 300 parts |

EXAMPLE 14

| | |
|---|---|
| Lanox FPS-2 (melting point = 67° C., melt viscosity = 35 cps at 100° C., ΔT = 11° C.) | 45 parts |
| Ethylene-vinyl acetate copolymer (Evaflex V5411, mfd. by Mitsui-Du Pont Polychemical Co., MFR = 320, VA content = 28%) | 40 parts |
| Carbon black (MA-11, mfd. by Mitsubishi Kasei K.K.) | 15 parts |
| Toluene | 300 parts |

EXAMPLE 15

| | |
|---|---|
| Lanox FPS-2 (melting point = 67° C., melt viscosity = 35 cps at 100° C., ΔT = 11° C.) | 40 parts |
| Ethylene-vinyl acetate copolymer (Evaflex EV220, mfd. by Mitsui-Du Pont Polychemical Co., MFR = 150, VA content = 28%) | 45 parts |
| Carbon black (MA-11, mfd. by Mitsubishi Kasei K.K.) | 15 parts |
| Toluene | 300 parts |

EXAMPLE 16

| | |
|---|---|
| Lanox FPS-2 (melting point = 67° C., melt viscosity = 35 cps at 100° C., ΔT = 11° C.) | 40 parts |
| Ethylene-vinyl acetate copolymer (Evaflex V5772, mfd. by Mitsui-Du Pont Polychemical Co., MFR = 400, VA content = 33%) | 45 parts |
| Carbon black (MA-11, mfd. by Mitsubishi Kasei K.K.) | 15 parts |
| Toluene | 300 parts |

EXAMPLE 17

| | |
|---|---|
| Lanox FPS-24 (melting point = 63° C., melt viscosity = 33 cps at 100° C., ΔT = 10° C.) | 45 parts |
| Ethylene-vinyl acetate copolymer (Evaflex V5772, mfd. by Mitsui-Du Pont Polychemical Co., MFR = 400, VA content = 33%) | 40 parts |
| Carbon black (MA-11, mfd. by Mitsubishi Kasei K.K.) | 15 parts |
| Toluene | 300 parts |

EXAMPLE 18

| | |
|---|---|
| Lanox FPS-2 (melting point = 67° C., melt viscosity = 35 cps at 100° C., ΔT = 11° C.) | 55 parts |
| Ethylene-vinyl acetate copolymer (Evaflex EV210, mfd. by Mitsui-Du Pont Polychemical Co., MFR = 400, VA content = 28%) | 30 parts |
| Carbon black (MA-11, mfd. by Mitsubishi Kasei K.K.) | 15 parts |
| Toluene | 300 parts |

EXAMPLE 19

| | |
|---|---|
| Lanox FPS-2 (melting point = 67° C., melt viscosity = 35 cps at 100° C., ΔT = 11° C.) | 30 parts |
| Ethylene-vinyl acetate copolymer (Evaflex EV210, mfd. by Mitsui-Du Pont Polychemical Co., MFR = 400, VA content = 28%) | 55 parts |
| Carbon black (MA-11, mfd. by Mitsubishi Kasei K.K.) | 15 parts |
| Toluene | 300 parts |

COMPARATIVE EXAMPLE 5

| | |
|---|---|
| Lanox FPS-2 (melting point = 67° C., melt viscosity = 35 cps at 100° C., ΔT = 11° C.) | 15 parts |
| Ethylene-vinyl acetate copolymer (Evaflex EV210, mfd. by Mitsui-Du Pont Polychemical Co., MFR = 400, VA content = 28%) | 70 parts |
| Carbon black (MA-11, mfd. by Mitsubishi Kasei K.K.) | 15 parts |
| Toluene | 300 parts |

COMPARATIVE EXAMPLE 6

| | |
|---|---|
| Lanox FPS-2 (melting point = 67° C., melt viscosity = 35 cps at 100° C., ΔT = 11° C.) | 70 parts |
| Ethylene-vinyl acetate copolymer (Evaflex EV210, mfd. by Mitsui-Du Pont Polychemical Co., MFR = 400, VA content = 28%) | 15 parts |
| Carbon black (MA-11, mfd. by Mitsubishi Kasei K.K.) | 15 parts |
| Toluene | 300 parts |

EXAMPLE 20

| | |
|---|---|
| Ethylene-vinyl acetate copolymer (Evaflex 410, mfd. by Mitsui-Du Pont Polychemical Co., MFR = 400, VA content = 19%) | 3 parts |
| Lanolin wax (Lanox CNB-500, mfd. by Yoshikawa Seiyu K.K., melting point = 82° C., acid value = 5.4) | 9 parts |
| Carbon black (MA-11, mfd. by Mitsubishi Kasei K.K.) | 3 parts |
| Toluene | 85 parts |

The above materials were dissolved or dispersed by means of a sand mill, thereby to prepare a coating liquid for heat-transferable ink. The coating liquid was applied onto a 6 micron-thick polyester film having a back surface treated with silicone resin, by means of a wire bar and then dried to form thereon a heat-transferable ink layer having a coating amount of 15 g/m$^2$ (after drying), whereby a thermal transfer material having a structure as shown in FIG. 7 was obtained.

EXAMPLES 21–31

The materials as described hereinafter were respectively dissolved or dispersed by means of a sand mill, thereby to prepare 11 species of coating liquids for heat-transferable ink. Each coating liquid was applied onto a 6 micron-thick polyester film having a treated back surface, by means of a wire bar and then dried by using hot air to form thereon a heat-transferable ink layer having a coating amount of 16 g/m$^2$ (after drying), whereby 11 species of thermal transfer materials were obtained.

EXAMPLE 21

| | |
|---|---|
| Carnauba Wax No. 1 (mfd. by Kato Yoko K.K., melting point = 83° C., ΔT = 18° C.) | 42 parts |
| Ethylene-vinyl acetate copolymer (Evaflex 420, mfd. by Mitsui-Du Pont Polychemical Co., melting point = 78° C. MFR = 150, VA content = 19%) | 43 parts |
| Carbon black (MA-11, mfd. by Mitsubishi Kasei K.K.) | 15 parts |
| Toluene | 300 parts |

EXAMPLE 22

| | |
|---|---|
| Carnauba Wax No. 1 (mfd. by Kato Yoko K.K., melting point = 83° C., ΔT = 18° C.) | 42 parts |
| Ethylene-vinyl acetate copolymer | 43 parts |

-continued

| | |
|---|---|
| (Evaflex 410, mfd. by Mitsui-Du Pont Polychemical Co., melting point = 74° C. MFR = 400, VA content = 19%) | |
| Carbon black (MA-11, mfd. by Mitsubishi Kasei K.K.) | 15 parts |
| Toluene | 300 parts |

EXAMPLE 23

| | |
|---|---|
| Paraffin wax (HNP-11 mfd. by Nihon Seiro K.K., melting point = 69° C., ΔT = 15° C.) | 40 parts |
| Ethylene-vinyl acetate copolymer (Evaflex 410, mfd. by Mitsui-Du Pont Polychemical CO., melting point = 74° C. MFR = 400, VA content = 19%) | 45 parts |
| Carbon black (MA-11, mfd. by Mitsubishi Kasei K.K.) | 15 parts |
| Toluene | 300 parts |

EXAMPLE 24

| | |
|---|---|
| Paraffin wax No. 1 (Paraffin Wax HNP-11, mfd. by Nihon Seiro K.K., melting point = 69° C., ΔT = 15° C.) | 45 parts |
| Ethylene-vinyl acetate copolymer (Evaflex 210, mfd. by Mitsui-Du Pont Polychemical Co., melting point = 62° C.) | 40 parts |
| Carbon black (MA-11, mfd. by Mitsubishi Kasei K.K.) | 15 parts |
| Toluene | 300 parts |

EXAMPLE 25

| | |
|---|---|
| Wax (Lanox FPS-3, mfd. by Yoshikawa Seiyu K.K., melting point = 67° C., ΔT = 11° C.) | 45 parts |
| Ethylene-vinyl acetate copolymer (Evaflex 210, mfd. by Mitsui-Du Pont Polychemical Co., melting point = 62° C. MFR = 400, VA content = 28%) | 40 parts |
| Carbon black (MA-11, mfd. by Mitsubishi Kasei K.K.) | 15 parts |
| Toluene | 300 parts |

EXAMPLE 26

| | |
|---|---|
| Wax (Lanox FPS-3, mfd. by Yoshikawa Seiyu K.K., melting point = 67° C., ΔT = 11° C.) | 45 parts |
| Ethylene-vinyl acetate copolymer (Evaflex 410, mfd. by Mitsui-Du Pont Polychemical Co., melting point = 74° C. MFR = 400, VA content = 19%) | 40 parts |
| Carbon black (MA-11, mfd. by Mitsubishi Kasei K.K.) | 15 parts |
| Toluene | 300 parts |

EXAMPLE 27

| | |
|---|---|
| Wax (Lanox FPL244, mfd. by Yoshikawa Seiyu K.K., melting point = 72° C., ΔT = 16° C.) | 45 parts |
| Ethylene-vinyl acetate copolymer (Evaflex 410, mfd. by Mitsui-Du Pont Polychemical Co., melting point = 74° C. MFR = 400, VA content = 19%) | 40 parts |

-continued

| | |
|---|---|
| Carbon black (MA-11, mfd. by Mitsubishi Kasei K.K.) | 15 parts |
| Toluene | 300 parts |

EXAMPLE 28

| | |
|---|---|
| Wax (Lanox FPS-3, mfd. by Yoshikawa Seiyu K.K., melting point = 67° C., ΔT = 11° C.) | 55 parts |
| Ethylene-vinyl acetate copolymer (Evaflex 210, mfd. by Mitsui-Du Pont Polychemical Co., melting point = 62° C. MFR = 400, VA content = 28%) | 30 parts |
| Carbon black (MA-11, mfd. by Mitsubishi Kasei K.K.) | 15 parts |
| Toluene | 300 parts |

EXAMPLE 29

| | |
|---|---|
| Wax (Lanox FPS-3, mfd. by Yoshikawa Seiyu K.K., melting point = 67° C., ΔT = 11° C.) | 30 parts |
| Ethylene-vinyl acetate copolymer (Evaflex 210, mfd. by Mitsui-Du Pont Polychemical Co., melting point = 62° C. MFR = 400, VA content = 28%) | 55 parts |
| Carbon black (MA-11, mfd. by Mitsubishi Kasei K.K.) | 15 parts |
| Toluene | 300 parts |

EXAMPLE 30

| | |
|---|---|
| Wax (Lanox FPS-3, mfd. by Yoshikawa Seiyu K.K., melting point = 67° C., ΔT = 11° C.) | 45 parts |
| Ethylene-vinyl acetate copolymer (Evaflex 420, mfd. by Mitsui-Du Pont Polychemical Co., melting point = 78° C. MFR = 150, VA content = 19%) | 40 parts |
| Carbon black (MA-11, mfd. by Mitsubishi Kasei K.K.) | 15 parts |
| Toluene | 300 parts |

EXAMPLE 31

| | |
|---|---|
| Wax (Lanox RPL244, mfd. by Yoshikawa Seiyu K.K., melting point = 72° C., ΔT = 16° C.) | 45 parts |
| Ethylene-vinyl acetate copolymer (Evaflex V5772, mfd. by Mitsui-Du Pont Polychemical Co., melting point = 52° C. MFR = 400, VA content = 33%) | 40 parts |
| Carbon black (MA-11, mfd. by Mitsubishi Kasei K.K.) | 15 parts |
| Toluene | 300 parts |

EXAMPLE 32 AND COMPARATIVE EXAMPLE 7

| | |
|---|---|
| <Coating Liquid A> | |
| Wax (Lanox FPS-2, mfd. by Yoshikawa Seiyu K.K., melting point = 67° C., melt viscosity = 35 cps at 100° C., ΔT = 11° C.) | 50 parts |
| Ethylene-vinyl acetate copolymer (Evaflex 210, mfd. by Mitsui-Du Pont | 50 parts |

-continued

| | |
|---|---|
| Polychemical Co., melting point = 62° C. MFR = 400, VA content = 28%) | |
| Toluene | 300 parts |
| <Coating Liquid B> | |
| Carnauba wax (Carnauba No. 1, mfd. by Kato Yoko K.K., melting point = 83° C., ΔT = 18° C.) | 90 parts |
| Ethylene-vinyl acetate copolymer (Evaflex 410, mfd. by Mitsui-Du Pont Polychemical Co., melting point = 74° C. MFR = 400, VA content = 19%) | 10 parts |
| Toluene | 300 parts |
| <Coating Liquid C> | |
| Wax (Lanox FRS-237, mfd. by Yoshikawa Seiyu K.K., melting point = 70° C., melt viscosity = 31 cps at 110° C., ΔT = 16° C.) | 45 parts |
| Ethylene-vinyl acetate copolymer (Evaflex 410, mfd. by Mitsui-Du Pont Polychemical Co., melting point = 64° C. MFR = 400, VA content = 19%) | 40 parts |
| Carbon Black (MA-11, mfd. by Mitsubishi Kasei K.K.) | 15 parts |
| Toluene | 300 parts |
| <Coating Liquid D> | |
| Paraffin wax (HNP11 mfd. by Nihon Seiro K.K., melting point = 69° C., ΔT = 15° C.) | 75 parts |
| Ethylene-vinyl acetate copolymer (Evaflex 210, mfd. by Mitsui-Du Pont Polychemical Co., melting point = 62° C. MFR = 400, VA content = 28%) | 10 parts |
| Carbon black (MA-11, mfd. by Mitsubishi Kasei K.K.) | 15 parts |
| Toluene | 300 parts |

The above materials constituting the coating liquids A to D were dissolved or dispersed by means of a sand mill, thereby to prepare four species of coating liquids for heat-transferable ink. The coating liquids were applied onto a 6 micron-thick polyester film having a treated back surface as shown in the following Tables 1 and 2, by means of a wire bar and then dried by using hot air, whereby thermal transfer materials having a structure as shown in FIG. 12 were obtained. The ink layer 1*b* had a coating amount (after drying) of 12 g/m$^2$, and the top layer 1*c* had a coating amount (after drying) of 3 g/m$^2$.

TABLE 1

| | Ink layer | Top layer |
|---|---|---|
| Example 32 | Coating liquid C | Coating liquid A |

TABLE 2

| | Ink layer | Top layer |
|---|---|---|
| Comparative Example 7 | Coating liquid D | Coating liquid B |

EXAMPLES 33–39, AND COMPARATIVE EXAMPLES 8–9

| | |
|---|---|
| <Coating liquid 1> | |
| Ethylene-vinyl acetate copolymer (Evaflex 210, mfd. by Mitsui-Du Pont Polychemical Co., MFR = 400, VA content = 28%) | 40 parts |
| Wax (FP-7136, mfd. by Yoshikawa Seiyu K.K., mp = 60° C.) | 45 parts |

-continued

| | |
|---|---|
| Carbon black (MA-11, mfd. by Mitsubishi Kasei K.K.) | 15 parts |
| Toluene | 300 parts |

The above materials were dissolved or dispersed by means of a sand mill to prepare a coating liquid 1.

Coating liquids 2–24 were prepared in the same manner as in the Coating liquid 1 except for respectively using the following formulations.

| | |
|---|---|
| <Coating liquid 2> | |
| Ethylene-vinyl acetate copolymer (the same as in coating liquid 1) | 40 parts |
| Wax (FP-7208, mfd. by Yoshikawa Seiyu K.K., mp = 66° C.) | 45 parts |
| Carbon black (the same as in coating liquid 1) | 15 parts |
| Toluene | 300 parts |
| <Coating liquid 3> | |
| Ethylene-vinyl acetate copolymer (the same as in coating liquid 1) | 40 parts |
| Wax (CNB-25, mfd. by Yoshikawa Seiyu K.K., mp = 78° C.) | 45 parts |
| Carbon black (MA-11, mfd. by Mitsubishi Kasei K.K.) | 15 parts |
| Toluene | 300 parts |
| <Coating liquid 4> | |
| Ethylene-acrylic acid copolymer (MFR = 400, AA = 25%) | 40 parts |
| Wax (the same as in coating liquid 1) | 45 parts |
| Carbon black (the same as in coating liquid 1) | 15 parts |
| Toluene | 300 parts |
| <Coating liquid 5> | |
| Ethylene-acrylic acid (MFR = 400, AA = 25%) | 40 parts |
| Wax (the same as in coating liquid 1) | 45 parts |
| Carbon black (the same as in coating liquid 1) | 15 parts |
| Toluene | 300 parts |
| <Coating liquid 6> | |
| Ethylene-acrylic acid copolymer (MFR = 400, AA = 25%) | 40 parts |
| Wax (the same as in coating liquid 3) | 45 parts |
| Carbon black (the same as in coating liquid 1) | 15 parts |
| Toluene | 300 parts |
| <Coating liquid 7> | |
| Ethylene-acrylic acid copolymer (NUC6070, mfd. by Nippon Unicar K.K., MFR = 250, AA = 25%) | 40 parts |
| Wax (the same as in coating liquid 1) | 45 parts |
| Carbon black (the same as in coating liquid 1) | 15 parts |
| Toluene | 300 parts |
| <Coating liquid 8> | |
| Ethylene-acrylic acid copolymer (the same as in coating liquid 7) | 40 parts |
| Wax (the same as in coating liquid 2) | 45 parts |
| Carbon black (the same as in coating liquid 1) | 15 parts |
| Toluene | 300 parts |
| <Coating liquid 9> | |
| Ethylene-acrylic acid copolyer (the same as in coating liquid 7) | 40 parts |
| Wax (the same as in coating liquid 3) | 45 parts |
| Carbon black (the same as in coating liquid 1) | 15 parts |
| Toluene | 300 parts |

-continued

| | |
|---|---|
| <Coating liquid 10> | |
| Ethylene-vinyl acetate copolymer (the same as in coating liguid 1) | 40 parts |
| Wax (FPS-24, mfd. by Yoshikawa Seiyu K.K., mp = 63° C.) | 45 parts |
| Carbon black (the same as in coating liquid 1) | 15 parts |
| Toluene | 300 parts |
| <Coating liquid 11> | |
| Ethylene-vinyl acetate copolymer (the same as in coating liquid 1) | 40 parts |
| Wax (FPI-237, mfd. by Yoshikawa Seiyu K.K., mp = 70° C.) | 45 parts |
| Carbon black (the same as in coating liquid 1) | 15 parts |
| Toluene | 300 parts |
| <Coating liquid 12> | |
| Ethylene-vinyl acetate copolymer (the same as in coating liquid 1) | 40 parts |
| Wax (Hoechst Wax KFO, mfd. by Hoechst, mp = 83° C.) | 45 parts |
| Carbon black (the same as in coating liquid 1) | 15 parts |
| Toluene | 300 parts |
| <Coating liquid 13> | |
| Ethylene-vinyl acetate copolymer (Evaflex 220, mfd. by Mitsui-Du Pont Polychemical Co., MFR = 150, VA = 28%) | 63 parts |
| Wax (the same as in coating liquid 1) | 22 parts |
| Carbon black (the same as in coating liquid 1) | 15 parts |
| Toluene | 300 parts |
| <Coating liquid 14> | |
| Ethylene-vinyl acetate copolymer (the same as in coating liquid 13) | 63 parts |
| Wax (the same as in coating liquid 2) | 22 parts |
| Carbon black (the same as in coating liquid 1) | 15 parts |
| Toluene | 300 parts |
| <Coating liquid 15> | |
| Ethylene-vinyl acetate copolymer (the same as in coating liquid 13) | 63 parts |
| Wax (CNB-50, mfd. by Yoshikawa Seiyu K.K., mp = 82° C.) | 22 parts |
| Carbon black (the same as in coating liquid 1) | 15 parts |
| Toluene | 300 parts |
| <Coating liquid 16> | |
| Ethylene-vinyl acetate copolymer (the same as in coating liquid 13) | 35 parts |
| Wax (the same as in coating liquid 1) | 50 parts |
| Carbon black (the same as in coating liquid 1) | 15 parts |
| Toluene | 300 parts |
| <Coating liquid 17> | |
| Ethylene-vinyl acetate copolymer (the same as in coating liquid 13) | 35 parts |
| Wax (the same as in coating liquid 2) | 50 parts |
| Carbon black (the same as in coating liquid 1) | 15 parts |

-continued

| | |
|---|---|
| Toluene | 300 parts |
| <Coating liquid 18> | |
| Ethylene-vinyl acetate copolymer (the same as in coating liquid 13) | 35 parts |
| Wax (the same as in coating liquid 15) | 50 parts |
| Carbon black (the same as in coating liquid 1) | 15 parts |
| Toluene | 300 parts |
| <Coating liquid 19> | |
| Ethylene-vinyl acetate copolymer (the same as in coating liquid 13) | 64 parts |
| Wax (the same as in coating liquid 1) | 21 parts |
| Carbon black (the same as in coating liquid 1) | 15 parts |
| Toluene | 300 parts |
| <Coating liquid 20> | |
| Ethylene-vinyl acetate copolymer (the same as in coating liquid 13) | 64 parts |
| Wax (the same as in coating liquid 2) | 21 parts |
| Carbon black (the same as in coating liquid 1) | 15 parts |
| Toluene | 300 parts |
| <Coating liquid 21> | |
| Ethylene-vinyl acetate copolymer (the same as in coating liquid 13) | 64 parts |
| Wax (the same as in coating liquid 15) | 21 parts |
| Carbon black (the same as in coating liquid 1) | 15 parts |
| Toluene | 300 parts |
| <Coating liquid 22> | |
| Ethylene-vinyl acetate copolymer (the same as in coating liquid 13) | 30 parts |
| Wax (the same as in coating liquid 1) | 55 parts |
| Carbon black (the same as in coating liquid 1) | 15 parts |
| Toluene | 300 parts |
| <Coating liguid 23> | |
| Ethylene-vinyl acetate copolymer (the same as in coating liquid 13) | 30 parts |
| Wax (the same as in coating liquid 2) | 55 parts |
| Carbon black (the same as in coating liquid 1) | 15 parts |
| Toluene | 300 parts |
| <Coating liquid 24> | |
| Ethylene-vinyl acetate copolymer (the same as in coating liquid 13) | 30 parts |
| Wax (the same as in coating liquid 15) | 55 parts |
| Carbon black (the same as in coating liquid 1) | 15 parts |
| Toluene | 300 parts |

Each of the above coating liquids 1 to 24 was applied onto a 6 micron-thick polyester film having a treated back surface as shown in the following Tables 3 and 4, by means of a wire bar and then dried, whereby ten species of thermal transfer materials having a multi-layer structure were prepared. The coating amounts of respective layers are shown in parentheses in the following Tables 3 and 4 in terms of coating amount after drying.

TABLE 3

| | First ink layer | Second ink layer | Third ink layer | Fourth ink layer |
|---|---|---|---|---|
| Example 33 | coating liquid 3 (6 g/m$^2$) (6 g/m$^2$) | coating liquid 2 (6 g/m$^2$) | coating liquid 1 | — |
| Example 34 | coating liquid 6 (5 g/m$^2$) | coating liquid 5 (5 g/m$^2$) | coating liquid 4 (5 g/m$^2$) | — |
| Example 35 | coating liquid 9 (5 g/m$^2$) | coating liquid 8 (5 g/m$^2$) | coating liquid 7 (5 g/m$^2$) | — |
| Example 36 | coating liquid 11 | coating liquid 10 | — | — |

TABLE 3-continued

| | First ink layer | Second ink layer | Third ink layer | Fourth ink layer |
|---|---|---|---|---|
| | (7 g/m$^2$) | (7 g/m$^2$) | | |
| Example 37 | coating liquid 12 (4 g/m$^2$) | coating liquid 3 (3 g/m$^2$) | coating liquid 11 (3 g/m$^2$) | coating liquid 10 (4 g/m$^2$) |
| Example 38 | coating liquid 15 (5 g/m$^2$) | coating liquid 14 (5 g/m$^2$) | coating liquid 13 (5 g/m$^2$) | — |
| Example 39 | coating liquid 18 (5 g/m$^2$) | coating liquid 17 (5 g/m$^2$) | coating liquid 16 (5 g/m$^2$) | — |

TABLE 4

| | First ink layer | Second ink layer | Third ink layer |
|---|---|---|---|
| Comp. Example 8 | coating liquid 1 (5 g/m$^2$) | coating liquid 2 (5 g/m$^2$) | coating liquid 3 (5 g/m$^2$) |
| Comp. Example 9 | coating liquid 21 (5 g/m$^2$) | coating liquid 20 (5 g/m$^2$) | coating liquid 19 (5 g/m$^2$) |
| Comp. Example 9 | coating liquid 24 (5 g/m$^2$) | coating liquid 23 (5 g/m$^2$) | coating liquid 22 (5 g/m$^2$) |

The above-mentioned thermal transfer materials of Examples 1–39 and Comparative Examples 1–10 were evaluated by using a facsimile machine in double density recording. The facsimile machine used herein was one obtained by partially modifying a commercially available facsimile machine (trade name: Canofax 630, mfd. by Canon K.K.) so as to effect double density recording. In the resultant machine, mechanical and physical conditions were as follows:

(1) A full-multi (i.e., line-type) thick film-type thermal head of 8 pel/mm was assembled.

(2) The feed amount of a thermal transfer material was about 1/5 times that of a recording medium.

(3) The moving direction of the thermal transfer material was reverse to that of the recording medium.

(4) The printing speed on the recording medium was 25 mm/sec. At this time, the thermal transfer material had a relative velocity of 31.2 mm/sec with respect to the recording medium.

(5) The thermal head was energized so that it generated heat energy of 22 mJ/mm$^2$ at the surface thereof.

Evaluation was conducted by outputting an image corresponding to a Facsimile Test Chart No. 2 according to The Institute of Image Electronics Engineering of Japan on plain paper (TRW-1A, mfd. by Jujo Seishi K.K.) having a Bekk smoothness of 220 sec.

The results are shown in Tables 5–10 appearing hereinafter. The standards for evaluation used herein were as follows:

Ground staining o: Substantially no ground staining was observed.

Δ: Some ground staining was observed but the resultant images were acceptable for practical use.

x: Considerable ground staining was observed.

Whisker edge portion o: No whisker edge portion was observed.

Δ: Some whisker edge portions were observed but the resultant images were acceptable for practical use.

x: Considerable whisker edge portions were observed.

Reproducibility of one isolated dot o: The reproducibility of the isolated dot was good.

Δ: Some defects were observed but the resultant images were acceptable for practical use.

x: A large number of defects were observed.

Cutting property (clearness in the periphery of recorded images)

o: Cutting property was good.

Δ: Cutting property was somewhat poor, but the resultant images were acceptable for practical use.

x: Cutting property was poor.

Uniformity in recorded image density o: Substantially no image density unevenness in the form of streaks was observed, and uniform images were provided.

Δ: Some image density unevenness in the form of streaks was observed, but the resultant images were acceptable for practical use.

x: Considerable image density unevenness in the form of streaks was observed and no uniform image was provided.

Adhesion o: No white streaks were observed.

Δ: Minute white streaks were slightly observed in the case of a solid black image, but the resultant images were acceptable for practical use.

x: Noticeable white streaks were observed.

Transferability o: No defects were observed in the resultant recorded images.

Δ: Some defects were observed in the resultant recorded images, but the resultant images were acceptable for practical use.

x: Noticeable defects were observed in the resultant recorded image.

Resolution decrease in printed image o: No resolution decrease was observed even in thin line image portions, and printed letters were easy to read.

Δ: Some resolution decrease was observed in thin line image portions, but the printed letters were readable and acceptable for practical use.

x: Resolution of thin line image portions was considerably decreased and the printed images were difficult to read.

Curl o: The thermal transfer material was very slightly curled and was easy to handle.

Δ: The thermal transfer material was somewhat curled but was acceptable for practical use.

Ink dropout o: The ink was not dropped even when the thermal transfer material was crumpled by hand.

Δ: Ink dropping was observed when the thermal transfer material was crumpled by hand.

Figure 16:
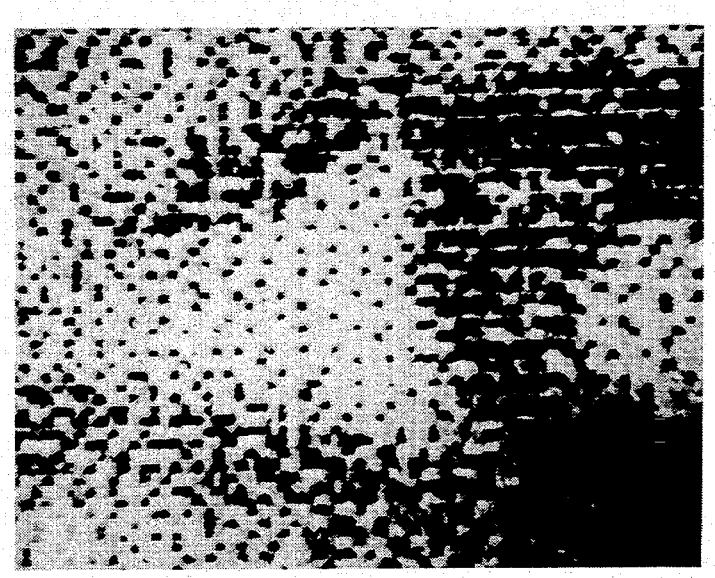
FIG. 16 is an enlarged photograph of a recorded image provided by the thermal transfer material of Example 7 appearing hereinafter.
Figure 17:
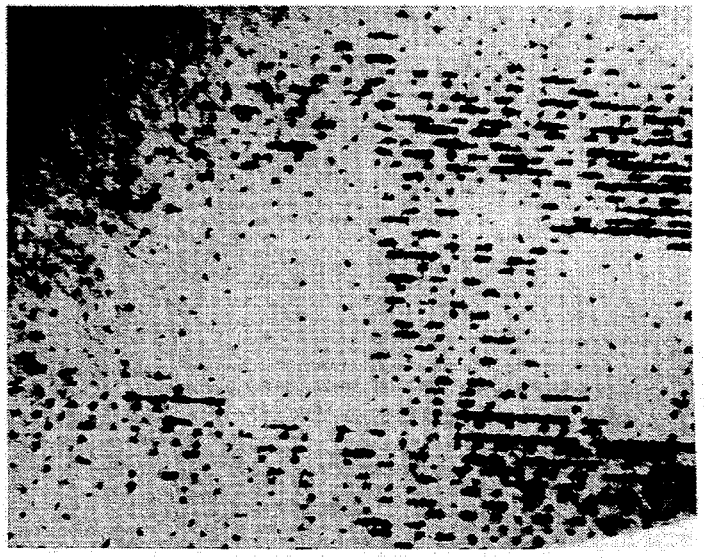
FIG. 17 is an enlarged photograph of a recorded image provided by the thermal transfer material of Comparative Example 3 appearing hereinafter.

The reproducibility of one isolated dot was evaluated by outputting a portrait image (an image portion of the left eye) contained in an evaluation image for "Canon GENESIS" on plain paper as a received image by means of the above-mentioned evaluation machine according to a half-tone mode, and evaluating the resultant image. The thus formed images corresponding to the left eye were photographed as shown in FIGS. 15 to 17.

Figure 15:
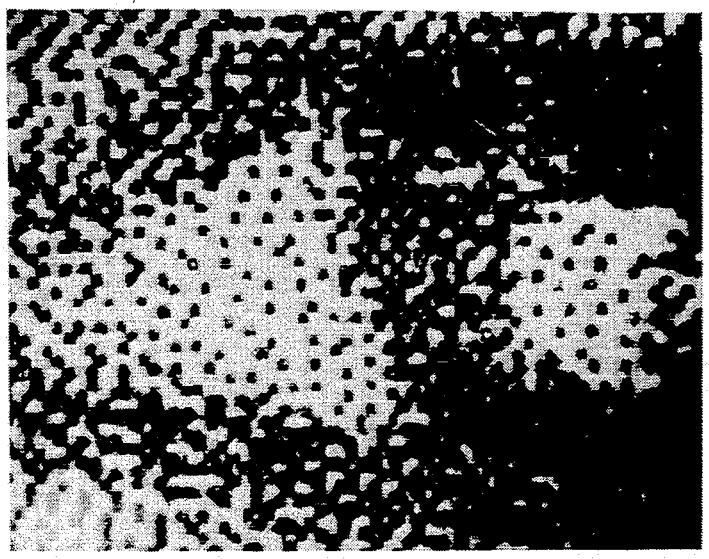
FIG. 15 is an enlarged photograph of a recorded image provided by the thermal transfer material of Example 1 appearing hereinafter.

FIG. 15 is an enlarged photograph of the image of the left eye output by using the thermal transfer material of Example 1. Similarly, FIG. 16 is an enlarged photograph of the left eye image output by using the thermal transfer material of Example 7, and FIG. 17 is an enlarged photograph of the left eye image output by using the thermal transfer material of Comparative Example 3. Each of the photographs of FIGS. 15 to 17 has a magnification of 11.3. As shown in these photographs, FIGS. 15 and 16 shows clearer recorded images of isolated one dot as compared with that in FIG. 17.

The thermal transfer material of Comparative Example 1 is a typical example of the thermal transfer material to be used for the conventional thermal transfer recording, wherein a thermal transfer material is conveyed while having no relative velocity with respect to a recording medium. The thermal transfer material of Comparative Example 1 was also evaluated by using a thermal transfer facsimile machine (trade name: Canofax 630, mfd. by Canon K.K.) without modification. As a result, the thermal transfer material of Comparative Example 1 in the case of the above conventional thermal transfer recording provided neither staining nor whisker edge portion, and provided clear printed letters while well reproducing one isolated dot.

Figure 18:
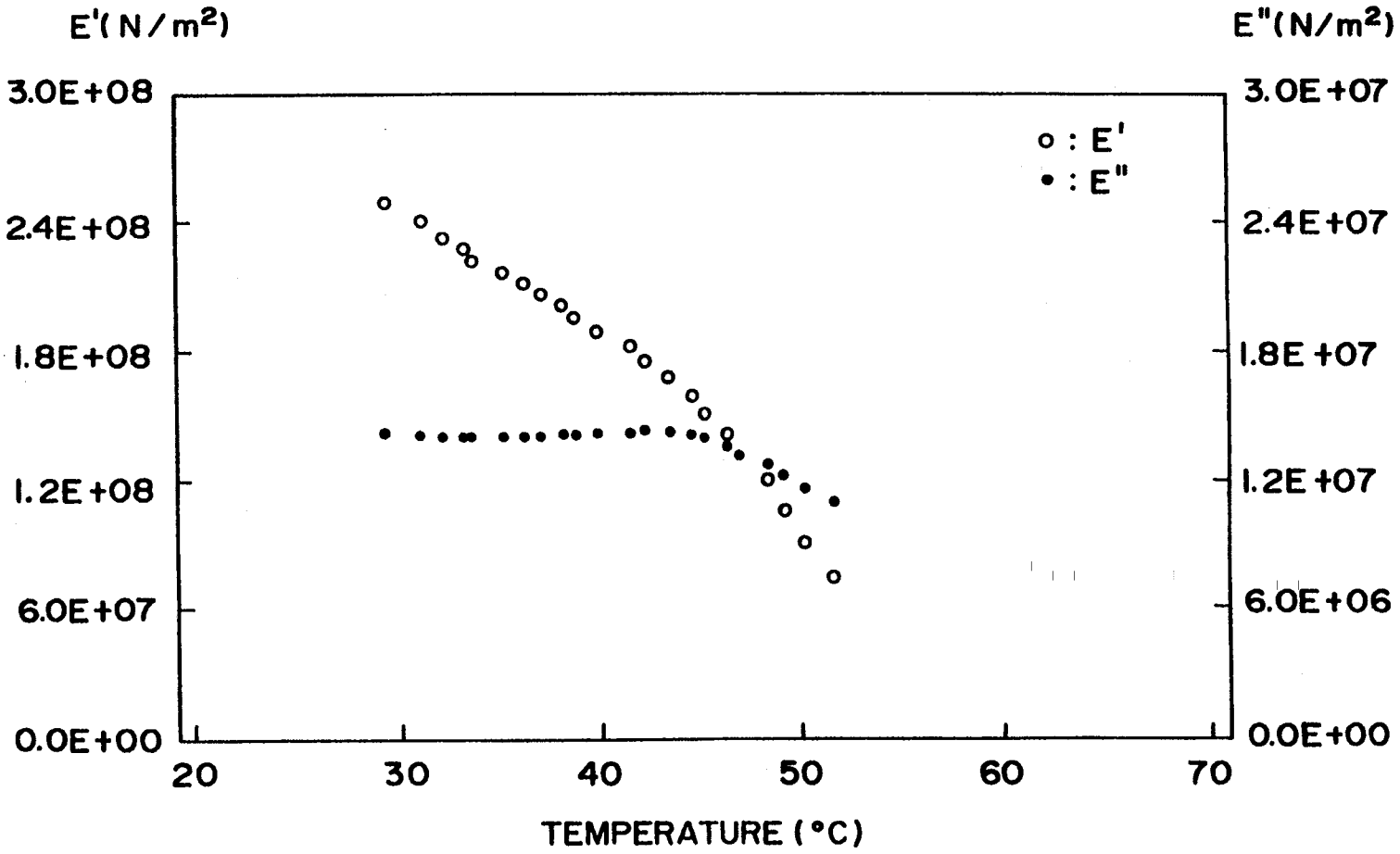
FIGS. 18–20 are graphs showing the results of measurements of E', E'' and tan δ with respect to the ink used in Example 1 appearing hereinafter.
Figure 19:
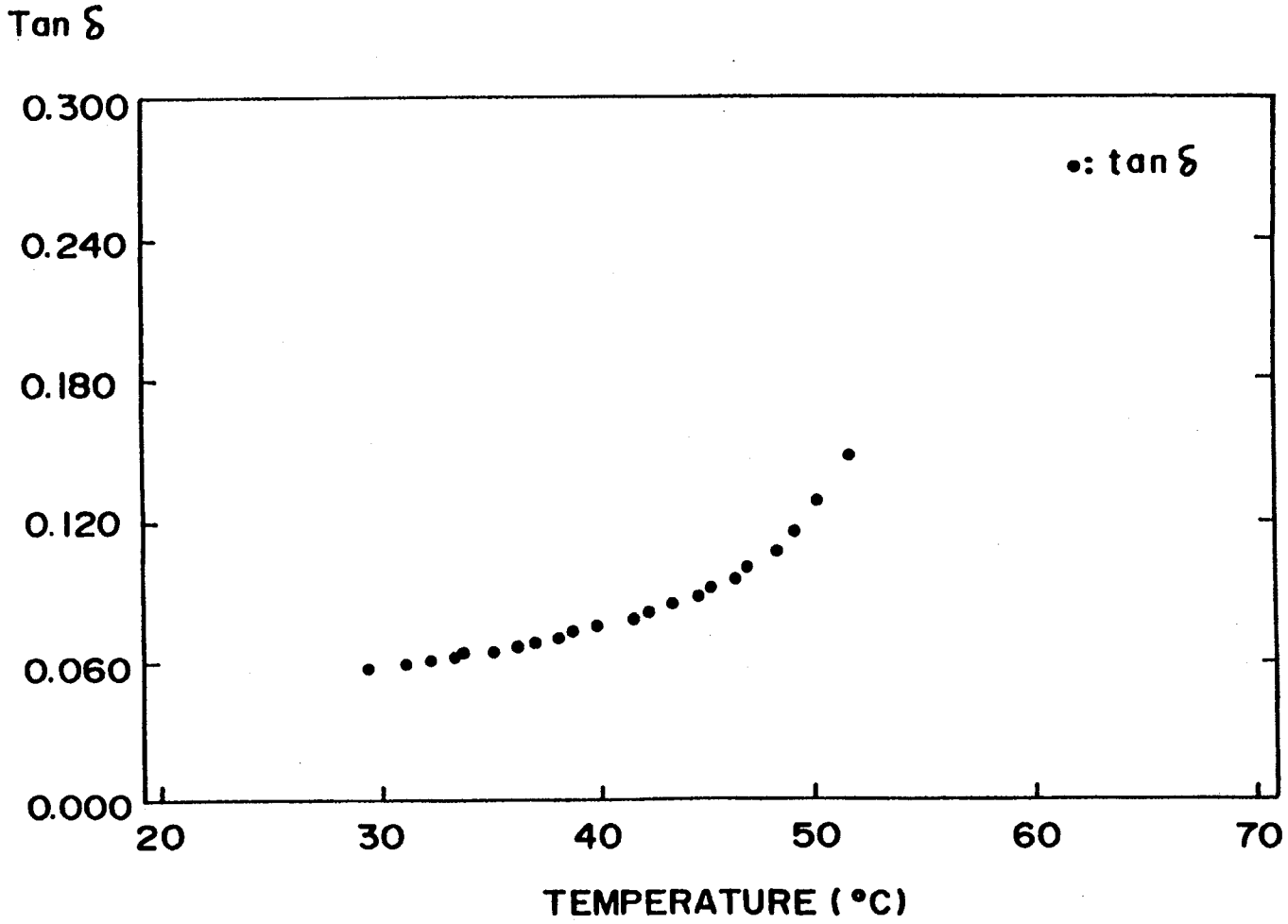
Figure 20:
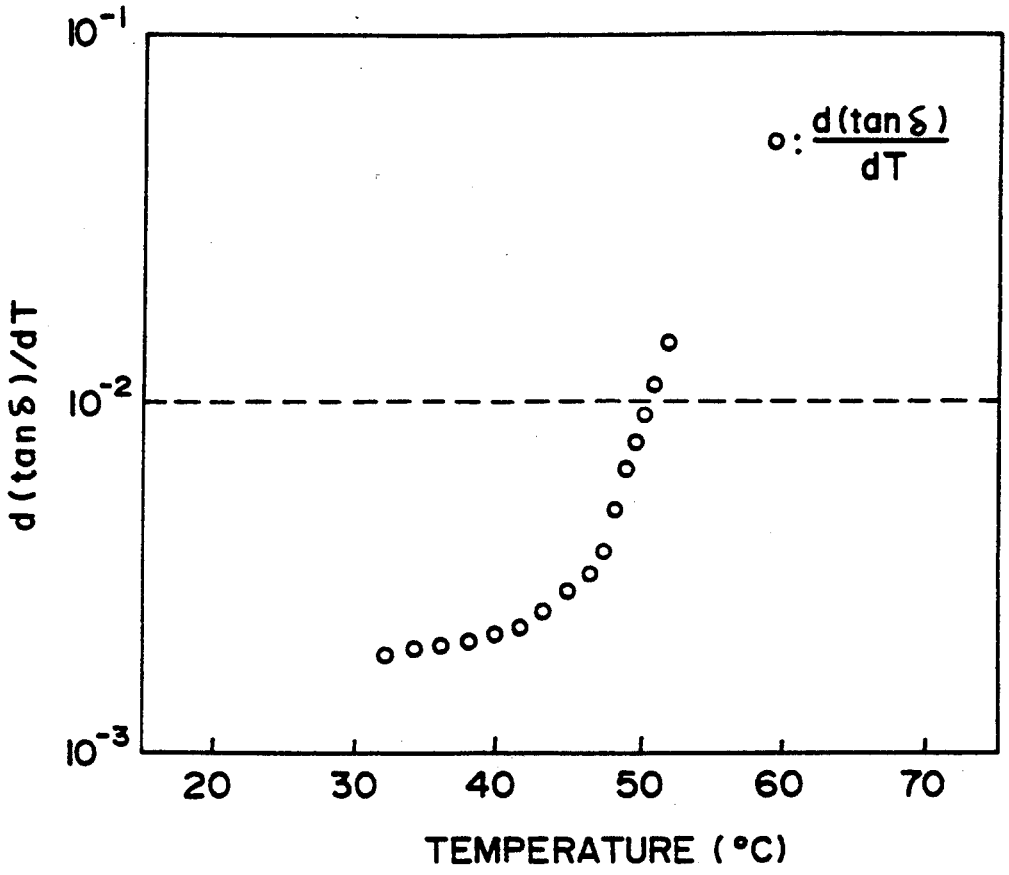

On the other hand, with respect to Examples 1–9 and Comparative Examples 1–4, thermal dispersion of E′, E″ and tan δ were measured by using the above-mentioned respective samples for dynamic viscoelasticity measurement. For example, measurement results with respect to Example 1 are shown in FIGS. 18 to 19. Based on the thermal dispersion of tan δ shown in FIG. 19, differential values at respective temperatures were plotted as shown in FIG. 20. By using the resultant FIG. 20, the temperature providing $d(\tan\delta/dT=1\times10^{-2}$ was determined. Measurements were conducted in the same manner as described above with respect to Examples 2–9 and Comparative Examples 1–4. The results are shown in the following Table 5.

The ink of the heat-transferable ink layer used in Example 20 was dried for melt viscosity measurement, and the melt viscosities thereof were measured by means of the above-mentioned device at 100° C. and 150° C. The results are shown in Table 7 appearing hereinafter.

TABLE 5

| Transfer material | E′ (N/m²) at 30° C. | Temperature (°C.) providing $d(\tan\delta)/dt = 1 \times 10^{-2}$ | Image evaluation: Reproducibility of one isolated dot | Ground staining | Whisker edge portion |
|---|---|---|---|---|---|
| Ex. 1 | $2.5 \times 10^8$ | 50.5 | ○ | ○ | ○ |
| Ex. 2 | $2.4 \times 10^8$ | 48.0 | ○ | ○ | ○ |
| Ex. 3 | $2.7 \times 10^8$ | 52.5 | ○ | ○ | ○ |
| Ex. 4 | $2.0 \times 10^8$ | 44.5 | ○ | Δ | Δ |
| Ex. 5 | $2.8 \times 10^8$ | 53.0 | ○ | ○ | ○ |
| Ex. 6 | $2.3 \times 10^8$ | 49.0 | ○ | ○ | ○ |
| Ex. 7 | $2.8 \times 10^8$ | 57.0 | Δ | ○ | ○ |
| Ex. 8 | $3.2 \times 10^8$ | 52.0 | ○ | ○ | ○ |
| Ex. 9 | $1.5 \times 10^8$ | 48.0 | ○ | ○ | ○ |
| Comp. Ex. 1 | $3.2 \times 10^8$ | 62.0 | x | x | x |
| Comp. Ex. 2 | $1.8 \times 10^8$ | 39.0 | ○ | x | Δ |
| Comp. Ex. 3 | $2.8 \times 10^8$ | 66.0 | x | ○ | ○ |
| Comp. Ex. 4 | $2.2 \times 10^8$ | 37.5 | ○ | x | x |

TABLE 6

| | Evaluation: Ground staining | Cutting property | Whisker edge portion | Uniformity in image density | Adhesion | Transfer-ability | Curl | Ink dropout |
|---|---|---|---|---|---|---|---|---|
| Ex. 10 | ○ | ○ | ○ | ○ | ○ | ○ | ○ | ○ |
| Ex. 11 | ○ | ○ | ○ | ○ | ○ | ○ | ○ | ○ |
| Ex. 12 | ○ | ○ | ○ | ○ | ○ | ○ | ○ | ○ |
| Ex. 13 | ○ | ○ | ○ | ○ | ○ | ○ | ○ | ○ |
| Ex. 14 | ○ | ○ | ○ | ○ | ○ | ○ | ○ | ○ |
| Ex. 15 | ○ | ○ | ○ | ○ | ○ | ○ | ○ | ○ |
| Ex. 16 | ○ | ○ | ○ | ○ | ○ | ○ | ○ | ○ |
| Ex. 17 | ○ | ○ | ○ | ○ | ○ | ○ | ○ | ○ |
| Ex. 18 | ○ | ○ | Δ | ○ | ○ | ○ | ○ | ○ |
| Ex. 19 | ○ | ○ | ○ | Δ | ○ | ○ | ○ | ○ |
| Comp. Ex. 5 | ○ | x | ○ | x | x | x | ○ | ○ |
| Comp. Ex. 6 | x | ○ | x | ○ | ○ | ○ | ○ | x |

TABLE 7

| | Melt viscosity of heat-transferable ink layer 100° C. | 150° C. | $\frac{\ln\eta_{100°C.} - \ln\eta_{150°C.}}{50}$ | Uniformity in image density |
|---|---|---|---|---|
| Examole 20 | 2500 | 550 | 0.030 | ○ |

TABLE 8

| | $mp_1-mp_2$ (°C.) | Evaluation: Adhesion | Ground staining | Whisker edge portion |
|---|---|---|---|---|
| Example 21 | 5 | ○ | ○ | ○ |
| Example 22 | 9 | ○ | ○ | ○ |
| Example 23 | −5 | ○ | Δ | ○ |
| Example 24 | 7 | ○ | Δ | ○ |
| Example 25 | 5 | ○ | ○ | ○ |
| Example 26 | −7 | ○ | ○ | ○ |
| Example 27 | −2 | ○ | ○ | ○ |
| Example 28 | 5 | ○ | ○ | ○ |
| Example 29 | 5 | ○ | ○ | ○ |
| Example 30 | −11 | Δ | ○ | ○ |
| Example 31 | 20 | Δ | ○ | ○ |

TABLE 9

| | Melting point of ink layer (°C.) Ink layer | Top layer | Evaluation: Ground staining | Whisker edge portion | Adhesion | Uniformity in image density | Reproducibility of isolated one dot | Resolution decrease in printed letter | Curl |
|---|---|---|---|---|---|---|---|---|---|
| Ex. 32 | 71.9 | 64.5 | ○ | ○ | ○ | ○ | ○ | ○ | ○ |
| Comp. Ex. 7 | 68.2 | 82.1 | ○ | Δ | Δ | Δ | x | x | Δ |

TABLE 10

| | Transferability | Ground staining | Whisker edge portion | Resolution decrease in printed letter |
|---|---|---|---|---|
| Ex. 33 | ○ | ○ | ○ | ○ |
| Ex. 34 | ○ | ○ | ○ | ○ |
| Ex. 35 | ○ | ○ | ○ | ○ |
| Ex. 36 | ○ | ○ | ○ | Δ |
| Ex. 37 | ○ | ○ | ○ | ○ |
| Ex. 38 | Δ | ○ | ○ | ○ |
| Ex. 39 | ○ | Δ | Δ | ○ |
| Comp. Ex. 8 | ○ | ○ | ○ | x |
| Comp. Ex. 9 | x | ○ | ○ | ○ |
| Comp. Ex. 10 | ○ | x | x | ○ |

What is claimed is:

1. A thermal transfer material comprising a support and a heat-transferable ink layer disposed thereon, wherein the heat-transferable ink layer has a storage elasticity modulus E' satisfying a relationship of:

$$1\times10^7 \leqq E' \leqq 1\times10^9 N/m^2$$

at 30° C.; and has a temperature providing a thermal differential value of dynamic energy loss angle (tan δ) satisfying a relationship of $d(\tan\delta)/dT = 1\times10^{-2}$ is in the range of 40° to 60° C.

2. A material according to claim 1, wherein the heat-transferable ink layer comprises a heat-fusible binder comprising a wax and a heat-fusible resin.

3. A material according to claim 2, wherein the binder comprises 20–75% thereof of the wax, and comprises 80–25% thereof of the heat-fusible resin.

4. A material according to claim 2, wherein the wax has a melting behavior ΔT of 20° C. or smaller.

5. A material according to claim 2, wherein the heat-fusible binder comprises at least one species selected from the group consisting of: ethylene-vinyl acetate copolymer, ethylene-acrylic acid copolymer, and ethylene-ethyl acrylate copolymer.

6. A material according to claim 5, wherein the heat-fusible resin has a melt flow rate of 150–800.

7. A material according to claim 5, wherein the content of the ethylene-vinyl acetate copolymer, ethylene-acrylic acid copolymer, or ethylene-ethyl acrylate copolymer is 15–33%.

8. A material according to claim 2, wherein the wax comprises a compound obtained by reacting an isocyanate group-containing compound with an ester compound prepared from a higher fatty acid and a polyhydric alcohol.

9. A material according to claim 2, wherein the wax comprises a polymerized product prepared from an isocyanate compound and a higher fatty acid pentaerythritol ester.

10. A material according to claim 1, wherein the heat-transferable ink layer comprises a heat-fusible binder comprising a higher fatty acid polyhydric alcohol ester and a polymerized product prepared from an isocyanate compound and a higher fatty acid pentaerythritol ester.

11. A material according to claim 1, wherein the heat-transferable ink layer has a melt viscosity satisfying the following relationship (2):

$$(\ln\eta_{100°C.} - \ln\eta_{150°C.})/50 \leqq 0.05 \quad (2)$$

wherein $\eta_{100°C.}$ denotes a melt viscosity (cps) at 100° C., and $\eta_{150°C.}$ denotes a melt viscosity (cps) at 150° C.

12. A material according to claim 2, wherein the melting point ($mp_1$) of the wax and the melting point ($mp_2$) of the resin satisfy a relationship of:

$$|mp_2 - mp_1| \leqq 10° C.$$

13. A material according to claim 1, wherein the heat-transferable ink layer has a multi-layer structure.

14. A material according to claim 13, wherein the multi-layer structure contains a transparent top layer disposed most distant from the support.

15. A material according to claim 14, wherein the melting point mp(top) of the top layer and the melting point mp(ink) of the ink layer disposed between the top layer and the support satisfy a relationship of mp(ink)≧mp(top).

16. A material according to claim 2, wherein the heat-transferable ink layer has a multi-layer structure such that the ink layer closer to the support comprises a wax having a higher melting point than that of the wax contained in a layer which is adjacent to the ink layer and is more distant from the support than the ink layer.

* * * * *

UNITED STATES PATENT AND TRADEMARK OFFICE

CERTIFICATE OF CORRECTION

PATENT NO. : 5,389,429

DATED : February 14, 1995

INVENTORS : Yoshihisa Takizawa et al.

It is certified that error appears in the above-identified patent and that said Letters Patent is hereby corrected as shown below:

ON TITLE PAGE

In [56] References Cited, U.S. Patent Documents
"3,368,989 2/1966 Wissinger et al." should read
--3,368,989 2/1968 Wissinger et al.--.

COLUMN 2

Line 16, "corr." should read --corresponding--.

COLUMN 3

Line 32, "corr." should read --corresponding--.
Line 59, "$1X10^7 \leq E' \leq 1X10^8 N/m^2$" should read
--$1X10^7 \leq E' \leq 1X10^9 N/m^2$--.

COLUMN 7

Line 4, "$1X1X10^7 \leq E' \leq 1X10^9 N/m^2$." should read
--$1X10^7 \leq E' \leq 1X10^9 N/m^2$.--
Line 16, "because in the following manner:" should read
--be the following:--.
Line 33, "calorimetery)," should read --calorimetry),--.
Line 45, "presumably" should be deleted.

UNITED STATES PATENT AND TRADEMARK OFFICE

CERTIFICATE OF CORRECTION

PATENT NO. : 5,389,429

DATED : February 14, 1995

INVENTORS : Yoshihisa Takizawa et al.

It is certified that error appears in the above-identified patent and that said Letters Patent is hereby corrected as shown below:

COLUMN 10

Line 9, "has" should read --have--.
Line 28, "5°" should read --5--.
Line 33, "exceeds" should read --exceed--.

COLUMN 13

Line 44, "those" should read --that--.

COLUMN 16

Line 21, "Fastgert" should read --Fastgen--.
Line 34, "phenolformal-" should read --phenol-formal---.

COLUMN 17

Line 12, "becomes" should read --become--.
Line 24, "130° C." should read --130° C,--.
Line 29, "preferably" should read --preferably be--.
Line 36, "is" should read --can--.

COLUMN 25

Line 16, "Polychemical CO.," should read --Polychemical Co.,--.

UNITED STATES PATENT AND TRADEMARK OFFICE

CERTIFICATE OF CORRECTION

PATENT NO. : 5,389,429

DATED : February 14, 1995

INVENTORS : Yoshihisa Takizawa et al.

It is certified that error appears in the above-identified patent and that said Letters Patent is hereby corrected as shown below:

COLUMN 30

Table 3, "coating liquid 1" should read
--coating liquid 1
(6 g/m²)--.

COLUMN 30

Table 3, "coating liquid 3
(6 g/m²)(6 g/m²)" should read
--coating liquid 3
(6 g/m²)--.

COLUMN 31

Table 4, "Comp. Example 9" (second occurrence) should read
--Comp. Example 10--.

COLUMN 33

Line 21, "shows" should read --show--.

UNITED STATES PATENT AND TRADEMARK OFFICE

CERTIFICATE OF CORRECTION

PATENT NO. : 5,389,429

DATED : February 14, 1995

INVENTORS : Yoshihisa Takizawa et al.

It is certified that error appears in the above-identified patent and that said Letters Patent is hereby corrected as shown below:

COLUMN 34

Line 17, "$\delta$/dT" should read --$\delta$)/dT--.
Table 6, Under Adhesion, Ex. 19, "°" should read --Δ--.

Signed and Sealed this

Fourth Day of July, 1995

Bruce Lehman

*Attest:*

BRUCE LEHMAN

*Attesting Officer*

*Commissioner of Patents and Trademarks*